US006148755A

United States Patent [19]

Wudtke et al.

[11] Patent Number: 6,148,755

[45] Date of Patent: Nov. 21, 2000

[54] REMOVABLE UNDERWATER FAIRLEAD AND METHOD

[75] Inventors: Donald J. Wudtke, Mt. Vernon; Robert C. Melder, Sedro-Wooley, both of Wash.

[73] Assignee: Oil States Industries, Inc., Arlington, Tex.

[21] Appl. No.: 09/237,342

[22] Filed: Jan. 26, 1999

Related U.S. Application Data

[60] Provisional application No. 60/072,599, Jan. 26, 1998, and provisional application No. 60/090,868, Jun. 26, 1998.

[51] Int. Cl.[7] ..... B63B 21/00

[52] U.S. Cl. ..... 114/230.2; 114/293; 254/415; 29/252

[58] Field of Search ..... 114/230.2, 230.23, 114/293, 101, 243; 29/244, 252; 254/413, 415

[56] References Cited

U.S. PATENT DOCUMENTS

| | | | |
|---|---|---|---|
| 310,386 | 1/1885 | Coop | 254/415 |
| 655,851 | 8/1900 | Coleman | 254/415 |
| 719,124 | 1/1903 | Marshall | 254/415 |
| 2,369,169 | 2/1945 | Mochel . | |
| 2,417,706 | 3/1947 | Scarborough . | |
| 2,990,803 | 7/1961 | Henderson . | |
| 3,166,038 | 1/1965 | Brittain et al. . | |
| 3,952,684 | 4/1976 | Ferguson et al. . | |
| 4,616,590 | 10/1986 | Albertini et al. . | |
| 4,793,739 | 12/1988 | Hasle et al. . | |
| 5,129,133 | 7/1992 | Reesor | 29/252 |
| 5,129,136 | 7/1992 | Richardson | 29/426.5 |
| 5,364,075 | 11/1994 | Montgomery . | |
| 5,649,635 | 7/1997 | Casavant et al. . | |
| 5,845,893 | 12/1998 | Groves | 254/389 |
| 5,896,639 | 4/1999 | Chen | 29/261 |

FOREIGN PATENT DOCUMENTS

| | | |
|---|---|---|
| 2935591 A1 | 3/1981 | Germany . |
| 2286173 | 8/1995 | United Kingdom . |
| WO 98/40306 | 9/1998 | WIPO . |

*Primary Examiner*—S. Joseph Morano
*Assistant Examiner*—Andrew D. Wright
*Attorney, Agent, or Firm*—Howrey Simon Arnold & White, LLP

[57] ABSTRACT

In a broad aspect, the invention relates to a new design for a fairlead that is capable of being remotely uninstalled from and then reinstalled on an offshore drilling and production vessel, while the vessel is in its moored position, in the event that the fairlead develops mechanical difficulties that require repair. Thus, the present invention discloses a fairlead that may be remotely uninstalled and reinstalled while the fairlead is underwater and without ballasting the vessel far enough to raise the fairlead above the water surface. The need for this invention primarily arises in connection with fairleads that are mounted to a vessel of the type where the ballasting process can be a very difficult, time-consuming, and expensive process.

15 Claims, 21 Drawing Sheets

REMOVABLE UNDERWATER FAIRLEAD AND METHOD

RELATED APPLICATIONS

This application claims the benefit of U.S. Provisional Application No. 60/072,599, filed Jan. 26, 1998, and of U.S. Provisional Application No. 60/090,868, filed Jun. 26, 1998.

BACKGROUND OF THE INVENTION

1. Field of the Invention

The present invention relates to offshore drilling vessels, and more particularly to methods and apparatus relating to fairleads.

2. Description of the Related Art

An offshore drilling vessel is essentially a massive, floating, mobile vessel used in the offshore exploration and/or production of oil and gas. The vessel is equipped with the necessary drilling tools to drill an oil and gas well into the ocean floor or produce the oil and gas to the surface for recovery. Up until the past few years, the typical offshore drilling vessel was of the type that generally includes two large pontoon hulls, at least four vertical support columns, and a drilling platform. The pontoon hulls float in the water horizontally and are parallel to one another. At least two support columns are attached to and extend vertically upwardly from each pontoon hull. The drilling platform is horizontally attached upon the vertical columns. This type of vessel is sometimes referred to as a "semi-submersible" vessel, and is towed from drilling site to drilling site by one or more boats.

Within the past few years, another type of offshore drilling and production vessel has been introduced to the market; this type of vessel is sometimes referred to as a spar-type vessel. This type of vessel is similar to the older semi-submersible-type vessel in that it includes a drilling and/or production platform, but differs in the flotation mechanism upon which the platform rests. More particularly, instead of using pontoon hulls and four vertical supports to support the platform, the spar-type vessel supports the platform with a single, long, slender cylinder, or support column, that is vertically moored in the water. This support column is sometimes referred to as a Deep Draft Caisson Vessel, or DDCV. As just one example, the cylinder may have a diameter of approximately 120 feet, and a length of approximately 500 feet. In this example, when moored in the drilling and/or production position, there may be approximately 50 to 80 feet of the cylinder exposed above the water line, with the remainder disposed below the water line.

Irrespective of the type of vessel, whether it be the older "semi-submersible" type or the newer "spar" type, the vessel must be anchored to the ocean floor before drilling begins. With a semi-submersible vessel, which is generally rectangular in shape, there will be at least one large mooring line, and sometimes more than one mooring line, at each corner of the vessel. Each mooring line is in turn connected to a large anchor at the ocean floor. With the spar-type vessel, there will be a number of anchors, perhaps as many as twelve, attached about the circumference of the support column, or DDCV, upon which the platform rests. With both types of vessels, each mooring line is tensioned or relaxed by its own mooring unit, through the use of a wire rope, chain, or combination wire rope/chain mooring line. In very broad terms, a mooring unit is essentially a giant hoist. Each type of vessel is also equipped with a "fairlead" for each mooring unit. A fairlead is essentially a pulley or sheave.

The fairleads are mounted to the vessel directly below each mooring unit. With the semi-submersible vessels, the fairleads are mounted to the vertical support members. With the spar-type vessels, the fairleads are mounted directly to the vertical support column, or DDCV. For each mooring unit, the mooring line exits the mooring unit and passes around its corresponding fairlead pulley or sheave before being connected to the anchor.

The present invention relates to fairleads, and the need for them to be accessible in the event they may experience mechanical difficulty and require repair. With the older semi-submersible type of vessel, the fairleads are generally located approximately ten to twenty feet below the water line when the vessel is in the moored position. In the event one of the fairleads needs to be repaired, the vessel can be raised, or "ballasted", out of the water far enough to elevate the fairleads above the water line; this "ballasted" position is the position in which semi-submersible vessels are placed when they are being moved from one drilling site to another. Once the vessel is ballasted, the fairlead may then either be repaired at the drilling site or the vessel could easily be moved to a dock for repair of the fairlead(s). With the newer spar-type vessel, however, the situation is different. When the spar-type vessel is in its moored or drilling position, the fairleads are located much farther below the water line; for the sample dimensions given above, the fairleads may be located approximately 120 feet below the water line. Further, it is not practical or feasible to "ballast" a spar-type vessel, whereas there is little difficulty in "ballasting" a semi-submersible vessel. In fact, it is not uncommon for spar-type vessels to be designed to be stationary in their moored positions for as long as twenty years. As such, the above-discussed approach to repairing fairleads on semi-submersible vessels is simply not workable for spar-type vessels. Accordingly, there has developed a need for a way to repair a fairlead on a spar-type vessel without "ballasting" the vessel. The present invention has been contemplated to meet this need.

SUMMARY OF THE INVENTION

In very broad terms, the present invention includes modified designs for a fairlead and methods of remotely detaching the fairlead from the vessel and retrieving it to the water surface for repair at the vessel site or for being transported to a remote site for repair, as well as methods for reinstalling the fairlead after it has been repaired. The underwater fairlead of the present invention is relatively easy to remotely remove and reinstall, without ballasting a spar-type vessel to which it is mounted. In very broad terms, the fairlead of the present invention may include a fairlead body and a fairlead pivot pin, or pivot pin, for holding the fairlead body to a pair of foundation supports on a support column of an offshore drilling and/or production platform. In one broad aspect, the present invention may be a removable fairlead designed to be detached from and reattached to the support column of the platform with the assistance of a strongback, which employs a pair of hydraulic rams with telescoping cylinders to break the pivot pin free from the fairlead body. The present invention further encompasses a method of removing and reinstalling the fairlead of this embodiment.

In another broad aspect, the present invention may be a removable fairlead designed to be detached from and reattached to the support column of the platform with the assistance of a jack screw assembly, which is adapted to be secured to an upper foundation support on the support column to insert and remove the pivot pin. The present invention further encompasses a method of removing and reinstalling the fairlead of this embodiment. This embodiment of the present invention further includes a method of inserting the pivot pin during the process of manufacturing the support column, at which time the support column is in a horizontal position, as opposed to the vertical position it is in when floating in the water at a drilling and/or production site.

In still another broad aspect, the present invention is directed to a strongback which employs a plurality of hydraulic rams to reinstall the fairlead after it has been removed. The present invention further encompasses a method of reinstalling the fairlead using the strongback.

In another aspect, the invention is a removable underwater fairlead comprising: a first fairlead foundation support connected to a support member of an offshore platform and having a first aperture, at least one flange having at least one upstanding member having a ram landing surface; a second fairlead foundation support connected to the support member of the offshore platform and having a second aperture; a fairlead body disposed between the first and second fairlead foundation supports, and having a bore therethrough; a fairlead pivot pin having a first end and a second end, and being removably disposed within the first and second apertures of the first and second fairlead foundation supports and within the bore of the fairlead body; and a pivot pin retainer attached to the first end of the pivot pin, releasably attachable to the first foundation support, and including at least one twistlock aperture, and at least one ram aperture alignable with the ram landing surface on the at least one upstanding member on the first fairlead foundation support. Another feature of this aspect of the present invention is that the at least one flange in the first fairlead foundation support further includes a clamp bolt aperture, and the pivot pin retainer further includes at least one clamp bolt aperture alignable with the clamp bolt aperture in the at least one flange. Another feature of this aspect of the present invention is that the fairlead body further includes a first attachment arm and a second attachment arm. Another feature of this aspect of the present invention is that the removable underwater fairlead may further include a first bushing having a tapered flange, the first bushing being disposed about the first end of the pivot pin and within the bore of the fairlead body, the tapered flange being disposed between a first surface of the fairlead body and a second surface of the first fairlead foundation support, the first foundation support including a recessed surface defining a first inclined surface adapted for cooperable engagement with a second inclined surface on the tapered flange. Another feature of this aspect of the present invention is that the removable underwater fairlead may further include a second bushing disposed about the second end of the pivot pin and within the bore of the fairlead body.

In another aspect, the present invention may be an apparatus for remotely removing and installing a removable underwater fairlead, the fairlead including a fairlead body hingedly connected between a first and a second fairlead foundation support by a pivot pin, the first fairlead foundation support having at least one upstanding member having a ram landing surface, the pivot pin being connected to a pivot pin retainer having at least one twistlock aperture and at least one ram aperture, the apparatus comprising: a main plate having a first surface and a second surface; a connector arm secured to the first surface of the main plate; at least one twistlock having a main shaft, a head, a lever arm attached to the head, and a flange, the head and flange being disposed at opposite ends of the main shaft, the main shaft being rotatably disposed within a twistlock bore in the main plate; and at least one ram connected to the main plate and having a telescoping cylinder movable between a retracted position and a deployed position. Another feature of this aspect of the present invention is that the head of the at least one twistlock is disposed adjacent the first surface of the main plate. Another feature of this aspect of the present invention is that the twistlock shaft is adapted for being rotatably disposed within the at least one twistlock aperture in the pivot pin retainer, and the twistlock flange is releasably engageable with the pivot pin retainer to releasably connect the main plate to the pivot pin retainer. Another feature of this aspect of the present invention is that the telescoping cylinder is adapted for being inserted through the at least one ram aperture in the pivot pin retainer to engage the ram landing surface of the at least one upstanding member on the first fairlead foundation support. Another feature of this aspect of the present invention is that the at least one ram is a hydraulic ram having a housing connected and substantially perpendicular to the first surface of the main plate, the telescoping cylinder extending from the housing through the main plate.

In another aspect, the present invention may be a method of removing a fairlead body hingedly connected below a water surface and between a first and a second fairlead foundation support by a pivot pin, the pivot pin being connected to a pivot pin retainer, the method comprising: removing the pivot pin from engagement with the fairlead body and the first and second fairlead foundation supports; removing the fairlead body from between the first and second fairlead foundation supports; and retrieving the fairlead body to a repair location above the water surface. Another feature of this aspect of the present invention is that the method may further include disconnecting the pivot pin retainer from the first fairlead foundation support before removing the pivot pin from engagement with the fairlead body and the first and second fairlead foundation supports. Another feature of this aspect of the present invention is that the method may further include retrieving the pivot pin to above the water surface. Another feature of this aspect of the present invention is that the method may further include using a strongback apparatus to remove the pivot pin, the strongback apparatus having a main plate having a first surface and a second surface, a connector arm secured to the first surface of the main plate, at least one twistlock having a main shaft, a head, a lever arm attached to the head, and a flange, the head and flange being disposed at opposite ends of the main shaft, the main shaft being rotatably disposed within a twistlock bore in the main plate, and at least one ram connected to the main plate and having a telescoping cylinder movable between a retracted position and a deployed position. Another feature of this aspect of the present invention is that the method may further include: inserting the main shaft and flange of the at least one twistlock through a twistlock aperture in the pivot pin retainer; rotating the main shaft and flange to fasten the strongback apparatus to the pivot pin retainer; and lifting the strongback apparatus to remove the pivot pin from engagement with the fairlead body and the first and second fairlead foundation supports. Another feature of this aspect of the present invention is that the method may further include: inserting the telescoping cylinder of the at least one ram through a ram aperture in the pivot pin retainer; shifting the telescoping cylinder into engagement with a ram landing surface on an upstanding member of the first fairlead foundation support; and forcing the telescoping cylinder against the ram landing surface to remove the pivot pin from engagement with the fairlead body and the first and second fairlead foundation supports.

In another aspect, the present invention may be a method of installing a fairlead body below a water surface and between a first and a second fairlead foundation support, the method comprising: lowering the fairlead body into a body of water; positioning the fairlead body between the first and second fairlead foundation supports; and inserting a pivot pin through a first aperture in the first fairlead foundation support, a bore in the fairlead body, and a second aperture in the second fairlead foundation support. Another feature of this aspect of the present invention is that the positioning step includes aligning the fairlead bore with the first and second apertures. Another feature of this aspect of the present invention is that the method may further include connecting a pivot pin retainer on the pivot pin to the first fairlead foundation support. Another feature of this aspect of the present invention is that the inserting step further includes pulling the pivot pin through the first aperture, the fairlead bore, and the second aperture. Another feature of this aspect of the present invention is that the pulling step includes connecting a line to a second end of the pivot pin, passing the line through the first aperture, the fairlead bore, the second aperture, and around a pulley, and applying an upward force to the line to apply a downward force to the pivot pin.

In another aspect, the present invention may be a removable underwater fairlead comprising: a first fairlead foundation support connected to a support member of an offshore platform and having a first aperture, at least one flange having a foundation twistlock installation aperture, and at least one upstanding member having a ram landing surface, the at least one flange being spaced from the ram landing surface; a second fairlead foundation support connected to the support member of the offshore platform and having a second aperture; a fairlead body disposed between the first and second fairlead foundation supports, and having a bore therethrough; a fairlead pivot pin having a first end and a second end, and being removably disposed within the first and second apertures of the first and second fairlead foundation supports and within the bore of the fairlead body; and a pivot pin retainer attached to the first end of the pivot pin, releasably attachable to the first foundation support, and including at least one twistlock removal aperture, at least one twistlock installation aperture alignable with the foundation twistlock installation aperture in the at least one flange, and at least one ram aperture alignable with the ram landing surface on the at least one upstanding member on the first fairlead foundation support. Another feature of this aspect of the present invention is that the at least one flange in the first fairlead foundation support further includes a clamp bolt aperture, and the pivot pin retainer further includes at least one clamp bolt aperture alignable with the clamp bolt aperture in the at least one flange. Another feature of this aspect of the present invention is that the fairlead body further includes a first attachment arm and a second attachment arm. Another feature of this aspect of the present invention is that the fairlead may further include a first bushing having a tapered flange, the first bushing being disposed about the first end of the pivot pin and within the bore of the fairlead body, the tapered flange being disposed between a first surface of the fairlead body and a second surface of the first fairlead foundation support, the first foundation support including a recessed surface defining a first inclined surface adapted for cooperable engagement with a second inclined surface on the tapered flange. Another feature of this aspect of the present invention is that the fairlead may further include a second bushing disposed about the second end of the pivot pin and within the bore of the fairlead body. Another feature of this aspect of the present invention is that a distance between an upper surface of the at least one flange on the first foundation support and a lower surface of the pivot pin retainer is greater than a height of a twistlock flange on a fairlead installation apparatus when the pivot pin is in an installed position.

In another aspect, the present invention may be an apparatus for remotely installing under water a removable underwater fairlead between a first and a second fairlead foundation support, the first fairlead foundation support having at least one upstanding member having a ram landing surface and at least one flange having a foundation twistlock aperture, the at least one flange being spaced from the ram landing surface, the pivot pin being connected to a pivot pin retainer having at least one twistlock installation aperture, the apparatus comprising: a main plate having a first surface and a second surface; a connector arm secured to the first surface of the main plate; at least one twistlock having a main shaft, a head, a lever arm attached to the head, and a flange, the head and flange being disposed at opposite ends of the main shaft, the main shaft being rotatably disposed within a twistlock bore in the main plate; and at least one ram connected to the main plate and having a telescoping cylinder movable between a retracted position and a deployed position. Another feature of this aspect of the present invention is that the head of the at least one twistlock is disposed adjacent the first surface of the main plate. Another feature of this aspect of the present invention is that the twistlock shaft is adapted for being rotatably disposed within the at least one twistlock installation aperture in the pivot pin retainer, the twistlock flange is releasably engageable with the pivot pin retainer, and the telescoping cylinder is adapted to engage the pivot pin retainer to releasably secure the pivot pin retainer to the installation apparatus between the telescoping cylinder and the twistlock flange. Another feature of this aspect of the present invention is that the twistlock shaft is adapted for being rotatably disposed within the at least one foundation twistlock installation aperture in the at least one flange on the first foundation support, the twistlock flange is releasably engageable with the at least one flange on the first foundation support to secure the installation apparatus to the first foundation support, and the telescoping cylinder is adapted to engage the pivot pin retainer to force the pivot pin into engagement with the first and second foundation supports and the fairlead body. Another feature of this aspect of the present invention is that the at least one ram is a hydraulic ram having a housing connected and substantially perpendicular to the first surface of the main plate, the telescoping cylinder extending from the housing through the main plate.

In another aspect, the present invention may be a method of using a strongback apparatus to install a fairlead body below a water surface and between a first and a second fairlead foundation support, the strongback apparatus having a main plate having a first surface and a second surface, a connector arm secured to the first surface of the main plate, at least one twistlock having a main shaft, a head, a lever arm attached to the head, and a flange, the head and flange being disposed at opposite ends of the main shaft, the main shaft being rotatably disposed within a twistlock bore in the main plate, and at least one ram connected to the main plate and having a telescoping cylinder movable between a retracted position and a deployed position, the method comprising: lowering the fairlead body into a body of water; positioning the fairlead body between the first and second fairlead foundation supports; inserting the flange and main shaft of the at least one twistlock through an at least one twistlock installation aperture in a pivot pin retainer attached to a pivot pin; rotating the main shaft to engage the twistlock flange with the pivot pin retainer; extending the telescoping cylinder into contact with the pivot pin retainer to securely engage the pivot pin retainer between the telescoping cylinder and the twistlock flange; inserting the pivot pin through a first aperture in the first foundation support and into a bore in the fairlead body; retracting the telescoping cylinder; rotating the main shaft and twistlock flange; inserting the flange and main shaft of the at least one twistlock through at least one foundation twistlock installation aperture in at least one flange on the first foundation support; rotating the main shaft to engage the twistlock flange with the at least one flange on the first foundation support; and extending the telescoping cylinder to engage the pivot pin retainer and force the pivot pin into a fully installed position. Another feature of this aspect of the present invention is that the method may further include: retracting the telescoping cylinder; rotating the main shaft and twistlock flange; removing the flange and main shaft from the at least one foundation twistlock installation aperture in the at least one flange on the first foundation support; rotating the main shaft and twistlock flange; and removing the flange and main shaft from the at least one twistlock installation aperture in the pivot pin retainer. Another feature of this aspect of the present invention is that the positioning step includes aligning the fairlead bore with the first and second apertures. Another feature of this aspect of the present invention is that the method may further include connecting a pivot pin retainer on the pivot pin to the first fairlead foundation support.

In another aspect, the present invention may be a removable underwater fairlead comprising: a first fairlead foundation support connected to a support member of an offshore platform and having a first aperture and a guiding sleeve; a second fairlead foundation support connected to the support member of the offshore platform and having a second aperture and a pivot pilot seat; a fairlead body disposed between the first and second fairlead foundation supports, and having a bore therethrough; and a fairlead pivot pin having a first end, a second end, and at least one mounting arm extending from the first end of the pivot pin, the at least one mounting arm including a first locking bore, the pivot pin being removably disposed within the first and second apertures of the first and second fairlead foundation supports and within the bore of the fairlead body. Another feature of this aspect of the present invention is that the guiding sleeve includes a means for guiding an apparatus for removing and installing the pivot pin into engagement with the guiding sleeve. Another feature of this aspect of the present invention is that the at least one mounting arm is adapted to releasably engage an apparatus for removing and installing the pivot pin. Another feature of this aspect of the present invention is that the first locking bore is adapted to receive an end of a jack screw, the jack screw having a connecting bore, the locking bore and the connecting bore being adapted to receive a locking pin to fasten the jack screw to the pivot pin. Another feature of this aspect of the present invention is that the second fairlead foundation support includes a pilot pivot seat engageable with the fairlead body. Another feature of this aspect of the present invention is that the removable underwater fairlead may further include a retainer pin removably engageable with a second end of the pivot pin.

In another aspect, the present invention may be an apparatus for remotely removing and installing a removable underwater fairlead, the fairlead including a fairlead body hingedly connected between a first and a second fairlead foundation support by a pivot pin, the first fairlead foundation support being connected to an offshore platform and having a guiding sleeve, the apparatus comprising: a housing; a jack screw having a first end and a second end, and being disposed for longitudinal movement within the housing, and releasably engageable with the pivot pin; and a motor connected to the jack screw. Another feature of this aspect of the present invention is that the motor is a hydraulic motor, and further including a source of pressurized fluid in communication with the hydraulic motor. Another feature of this aspect of the present invention is that the second end of the jack screw is adapted for releasable engagement with an at least one mounting arm extending from a first end of the pivot pin. Another feature of this aspect of the present invention is that the at least one mounting arm includes a first locking bore, and the second end of the jack screw includes a connecting bore, the locking bore and the connecting bore being adapted to receive a locking pin to fasten the jack screw to the pivot pin. Another feature of this aspect of the present invention is that the apparatus may further include a gear box connected between the jack screw and the motor.

In another aspect, the present invention may be a method of removing a fairlead body hingedly connected below a water surface and between a first and a second fairlead foundation support by a pivot pin, the first fairlead foundation support being connected to an offshore platform and having a guiding sleeve, the method comprising: guiding an apparatus for removing the pivot pin into engagement with the guiding sleeve; connecting the apparatus for removing the pivot pin to the pivot pin; connecting the fairlead body to a removal line; actuating the apparatus for removing the pivot pin to remove the pivot pin from engagement with the first fairlead foundation support, the fairlead body, and the second fairlead foundation support; removing the fairlead body from between the first and second fairlead foundation supports; and retrieving the fairlead body to a repair location above the water surface. Another feature of this aspect of the present invention is that the apparatus for removing the pivot pin includes a housing, a jack screw having a first end, a second end, and a connecting bore in the second end of the jack screw, and being disposed for longitudinal movement within the housing, and a motor connected to the jack screw, the steps of guiding the removing apparatus into engagement with the guiding sleeve and connecting the removing apparatus to the pivot pin including: positioning the housing with the guiding sleeve in abutting relationship with the first fairlead foundation support; aligning the connecting bore in the jack screw with a locking bore in an at least one mounting arm extending from the pivot pin; and placing a locking pin within the connecting bore and the locking bore. Another feature of this aspect of the present invention is that the method may further include connecting the removing apparatus to the first fairlead foundation support.

In another aspect, the present invention may be a method of installing a fairlead body below a water surface and between a first and a second fairlead foundation support, the first fairlead foundation support being connected to an offshore platform and having a guiding sleeve, the method comprising: lowering the fairlead body into a body of water; positioning the fairlead body between the first and second fairlead foundation supports; loading a pivot pin into an apparatus for installing the pivot pin; guiding the apparatus for installing the pivot pin into engagement with the guiding sleeve; connecting the installing apparatus to the first fairlead foundation support; and actuating the installing apparatus to push the pivot pin into engagement with the first fairlead foundation support, the fairlead body, and the second fairlead foundation support. Another feature of this aspect of the present invention is that the method may further include connecting the pivot pin to the second fairlead foundation support. Another feature of this aspect of the present invention is that the method may further include disconnecting the installation apparatus from the pivot pin, and removing the installation apparatus from the guiding sleeve. Another feature of this aspect of the present invention is that the method may further include providing means for stabilizing the fairlead body as it is being lowered through a body of water and into engagement with the first and second fairlead foundation supports. Another feature of this aspect of the present invention is that the positioning step includes engaging the fairlead body with a pilot pivot seat on the second fairlead foundation support.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

First Embodiment

Figure 1:
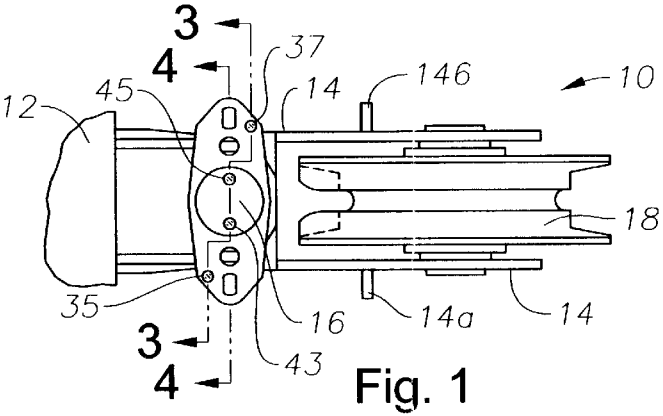
FIG. 1 is a top view of the fairlead of the present invention.
Figure 2:
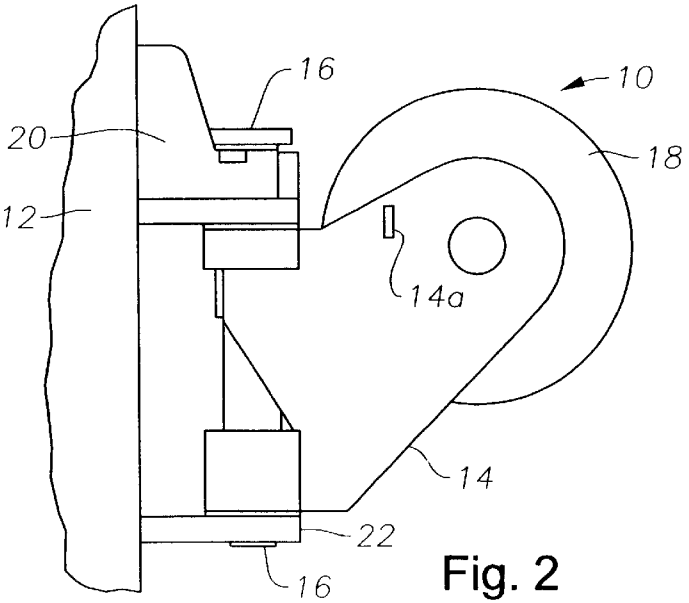
FIG. 2 is a side elevational view of the fairlead shown in FIG. 1.
Figure 3:
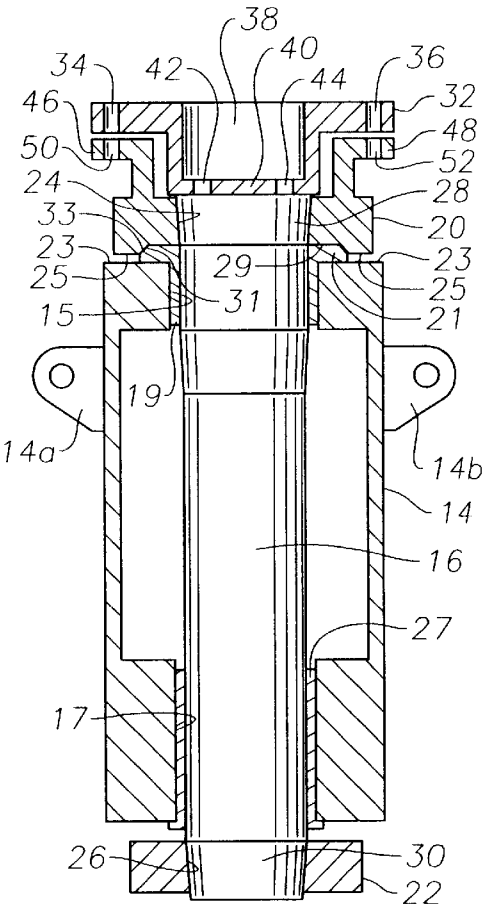
FIG. 3 is a cross-sectional view taken along line 3—3 of FIG. 1.
Figure 4:
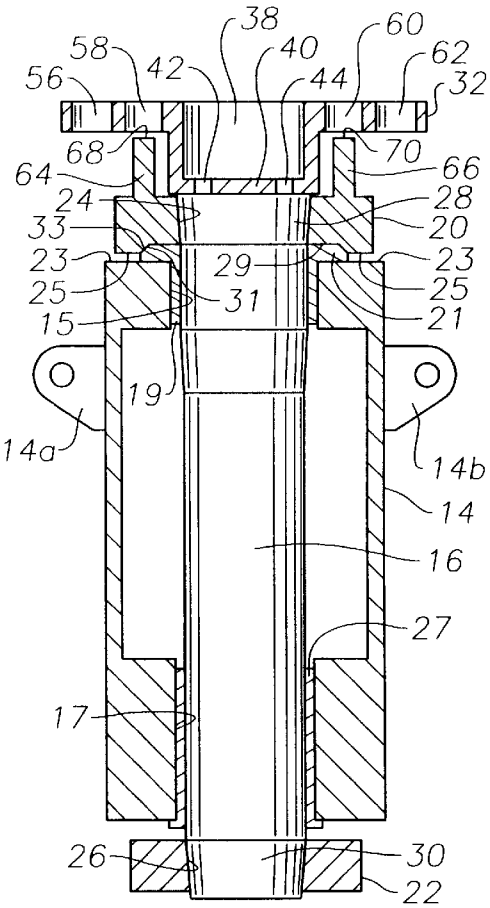
FIG. 4 is a cross-sectional view taken along line 4—4 of FIG. 1.

Referring to the drawings in detail, wherein like numerals denote identical elements throughout the several views, there is shown in FIGS. 1 and 2 a top and elevation view, respectively, of a fairlead 10 attached to a support column 12, or DDCV, of an offshore drilling and/or production vessel (not shown), such as a spar-type vessel. The fairlead 10 may broadly include: a fairlead body 14; and a fairlead pivot pin, or pivot pin 16. A sheave or pulley 18 is rotatably mounted to the fairlead body 14. The support column 12 includes a first fairlead foundation support 20 and a second fairlead foundation support 22. Referring to FIGS. 3 and 4, the first fairlead foundation support 20 includes a first aperture 24, and the second fairlead foundation support 22 includes a second aperture 26. The pivot pin 16 includes a first end 28 and a second end 30. A pivot pin retainer 32 is connected to the first end of the pivot pin 16. The fairlead body 14 may include a first attachment arm 14*a*, a second attachment arm 14*b*, a first bore 15 and a second bore 17. The fairlead body 14 is secured to the support column 12 by positioning the first end 28 of the pivot pin 16 within the first aperture 24 of the first foundation support 20 and within the first bore 15 of the fairlead body 14, and by positioning the second end 30 of the pivot pin 16 within the second bore 17 of the fairlead body 14 and within the second aperture 26 of the second foundation support 22. A first bushing 19 having a tapered flange 21 may be positioned about the first end 28 of the pivot pin 16 and within the first bore 15 of the fairlead body 14, such that the tapered flange 21 is positioned between a first surface 23 of the fairlead body 14 and a second surface 25 of the first foundation support 20. The second surface 25 of the first foundation support 20 may be provided with a recessed surface 29 that defines a first inclined surface 31 for mating with second inclined surface 33 on the tapered flange 21. The operation of the first bushing 19 and of its tapered flange 21 will be discussed below. A second bushing 27 may be positioned about the second end 30 of the pivot pin 16 and within the second bore 17 of the fairlead body 14.

While at first glance FIGS. 3 and 4 appear to be identical, upon close inspection it can be seen that there are differences. These differences, which are found at the upper portions of FIGS. 3 and 4, can best be visualized by viewing FIGS. 3 and 4 in conjunction with FIG. 1, and specifically with section lines 3—3 and 4—4.

The upper portion of FIG. 3 illustrates that the pivot pin retainer 32 may include a first clamp bolt aperture 34 and a second clamp bolt aperture 36. The pivot pin retainer 32 may also include a concentric cup portion 38 having a central member 40. The central member 40 may include a first pivot pin aperture 42 and a second pivot pin aperture 44. The pivot pin retainer 32 may be secured to the pivot pin 16 by passing connecting means, such as first and second pivot pin bolts 43 and 45, shown in FIG. 1, through the first and second pivot pin apertures 42 and 44, respectively, and fastening the pivot pin bolts 43 and 45 to the pivot pin 16, as by threads (not shown). It should be pointed out that the pivot pin 16 and the pivot pin retainer 32 may be made as an integral component, thereby removing the need for the first and second pivot pin apertures 42 and 44. Also illustrated in the upper portion of FIG. 3 is the first fairlead foundation support 20, which may include a first flange 46 and a second flange 48. The first flange 46 includes a third clamp bolt aperture 50 and the second flange 48 includes a fourth clamp bolt aperture 52. When the pivot pin 16 is in its installed position, as shown in FIGS. 3 and 4, the first clamp bolt aperture 34 on the pivot pin retainer 32 is aligned with the third clamp bolt aperture 50 on the first fairlead foundation support 20; and the second clamp bolt aperture 36 on the pivot pin retainer 32 is aligned with the fourth clamp bolt aperture 52 on the first fairlead foundation support 20. The pivot pin retainer 32 is securely fastened to the foundation support 20 by passing connection mechanisms, such as first and second clamp bolts 35 and 37, shown in FIG. 1, through their respective aligned clamp bolt apertures 34, 50 and 36, 52.

Figure 5:
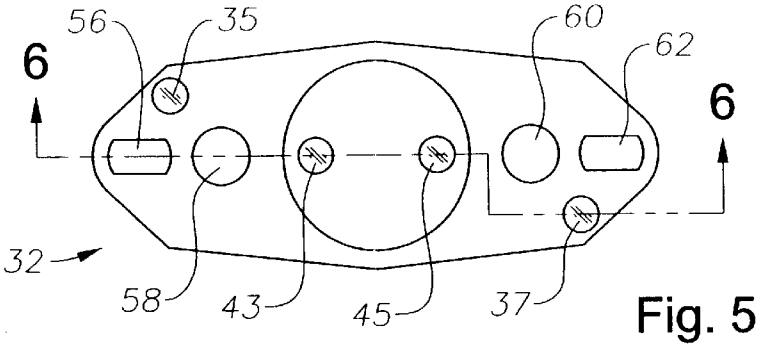
FIG. 5 is a top view of a pivot pin retainer.
Figure 6:
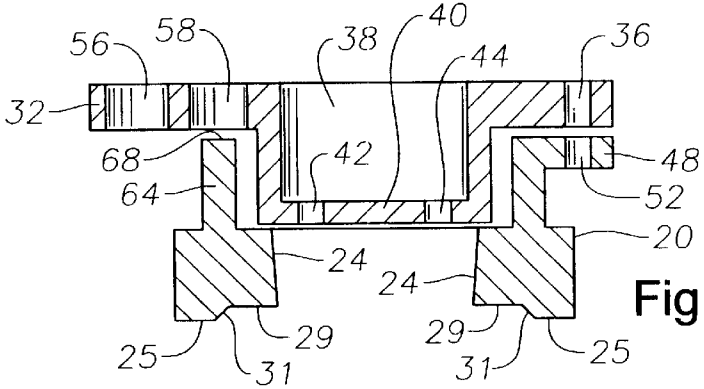
FIG. 6 is a cross-sectional view taken along line 6—6 of FIG. 5 showing the pivot pin retainer of FIG. 5 positioned directly above a first fairlead foundation support.

The upper portion of FIG. 4 illustrates that the pivot pin retainer 32 may include a first twistlock aperture 56, a first hydraulic ram aperture 58, a second hydraulic ram aperture 60, and a second twistlock aperture 62. FIG. 4 further illustrates that the first fairlead foundation support 20 may include a first upstanding member 64 and a second upstanding member 66. The first upstanding member 64 includes a first ram landing surface 68, and the second upstanding member 66 includes a second ram landing surface 70. When the pivot pin 16 is in its installed position, as shown in FIGS. 3 and 4, the first hydraulic ram aperture 58 is aligned with the first upstanding member 64 and the second hydraulic ram aperture 60 is aligned with the second upstanding member 66. FIGS. 5 and 6 further illustrate the design and structure of the pivot pin retainer 32 and the first fairlead foundation support 20, and their relationship to one another. FIG. 6 shows the pivot pin retainer 32 without the pivot pin 16 attached thereto.

The above description of the fairlead 10 of the present invention, as shown in FIGS. 1 to 6, illustrates the fairlead 10 when attached underwater to the support column 12, such that it is ready to use and operational. As discussed above, the fairlead 10 of the present invention is designed so that the fairlead body 14 can be remotely removed and reinstalled in the event mechanical difficulty with the fairlead body 14 arises and repair is required. Operational status of the fairlead 10 may be ascertained by visual inspection either by divers or by the use of a remotely operated vehicle (ROV) of the type well known to those of skill in the art, such as those having remotely operated mechanical arms and video cameras. Upon the detection of mechanical problems that require repair, the present invention provides a method of remotely removing the fairlead body 14 and retrieving it to the water surface for repair, and then reinstalling it, as will now be explained.

The first step is to attach a line extending from a crane (not shown) on the vessel's platform (not shown) to each of the attachment arms 14*a* and 14*b* on the fairlead body 14. The second step is to remove the clamp bolts 35 and 37 so as to disengage the pivot pin retainer 32 from the first foundation support 20. This can be done by the use of an ROV or by divers. The third step is to remove the pivot pin 16 so as to disengage the fairlead body 14 from the foundation supports 20 and 22. This can be done by use of a strongback 72, as shown in FIGS. 7 through 12. The strong back 72 will first be described with reference to FIG. 7 and 8, and its method of use will then be described with reference to FIGS. 8 to 12.

Figure 8:
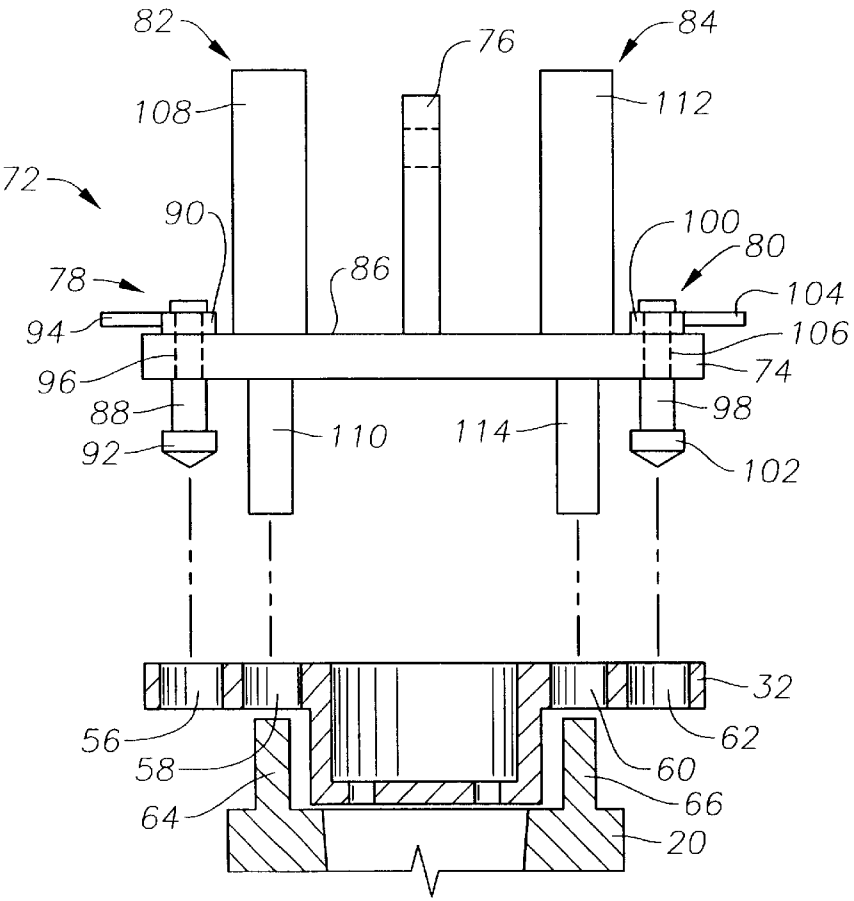
FIG. 8 is a front elevation view of the lifting strongback shown in FIG. 7 when it is being readied for use in removing the pivot pin retainer shown in FIG. 5 so as to enable the disengagement of a fairlead body of the fairlead from the support column (not shown) of the offshore drilling and production vessel (not shown).
Figure 7:
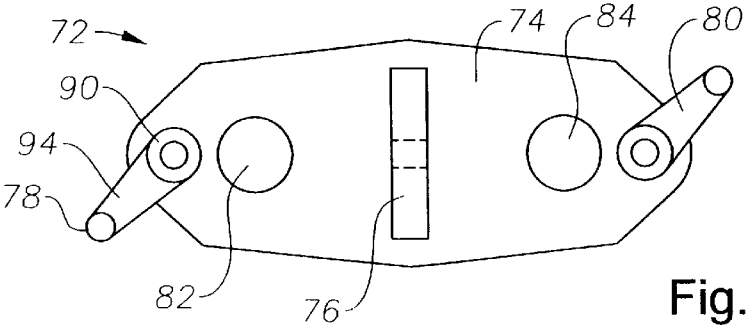
FIG. 7 is a top view of a lifting strongback for use in removing and reinstalling the fairlead shown in FIG. 1 from and to a support column (not shown) of an offshore drilling and production vessel (not shown).

Referring to FIG. 7 and 8, the strong back 72 may include a main plate 74, a connector arm 76, a first twistlock 78, a second twistlock 80, a first hydraulic ram 82, and a second hydraulic ram 84. The connector arm 76 is secured to a first surface 86 of the main plate 74 and is substantially perpendicular thereto. The first twistlock 78 may include a first main shaft 88 having a first head 90 and a first flange 92 disposed opposite the first head 90. A first lever arm 94 is attached to the first head 90. The first head 90 is adjacent the first surface 86 of the main plate 74. The first shaft 88 is rotatably located within a first twistlock bore 96 in the main plate 74. Similarly, the second twistlock 80 may include a second main shaft 98 having a second head 100 and a second flange 102 disposed opposite the second head 100. A second lever arm 104 is attached to the second head 100. The second head 100 is adjacent the first surface 86 of the main plate 74. The second shaft 98 is rotatably located within a second twistlock bore 106 in the main plate 74. The first hydraulic ram 82 includes a first main housing 108 and a first telescoping cylinder 110. The first main housing 108 is secured to the main plate 74 and is substantially perpendicular to the first surface 86 thereof The first telescoping cylinder 110 extends from the first main housing 108 through the main plate 74. Similarly, the second hydraulic ram 84 includes a second main housing 112 and a second telescoping cylinder 114. The second main housing 112 is secured to the main plate 74 and is substantially perpendicular to the first surface 86 thereof The second telescoping cylinder 114 extends from the second main housing 110 through the main plate 74. Each of the telescoping cylinders 110 and 114 may extend from a fully-retracted position (see FIGS. 9 and 10) to a fully-deployed position, as shown in FIG. 8. The hydraulic rams 82 and 84 may be actuated by hydraulic lines (not shown) connecting each ram 82 and 84 to a source of hydraulic fluid on the platform (not shown). Alternatively, the source of hydraulic fluid may be supplied by a remote-controlled self-contained hydraulic pump system (not shown) either mounted on-board the strongback 72 or to the support column 12.

Figure 9:
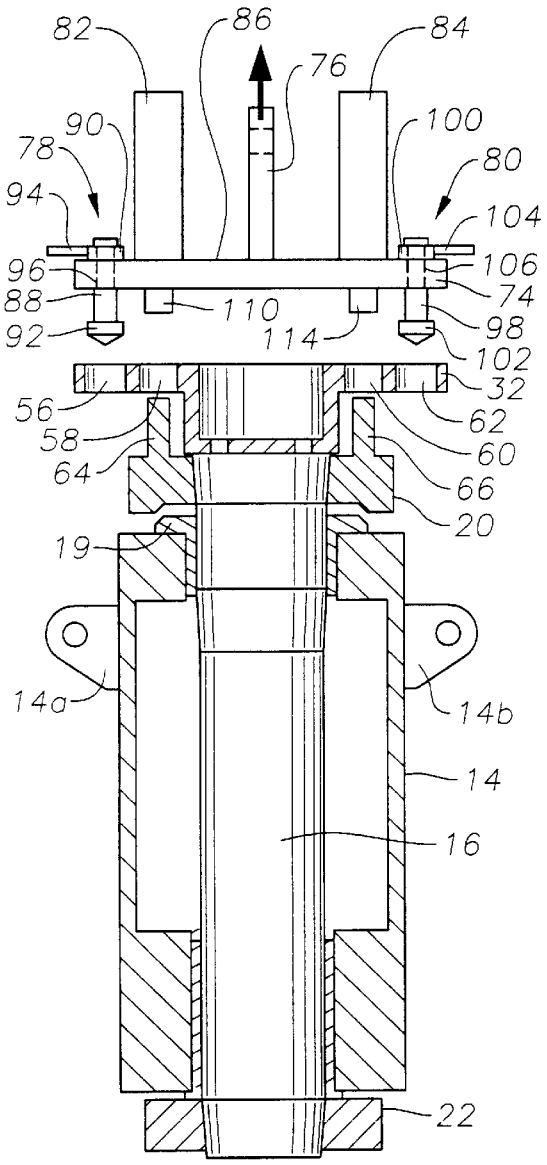
FIG. 9 is a view similar to FIG. 8 showing the strongback being lowered into position to remove the pivot pin.
Figure 10:
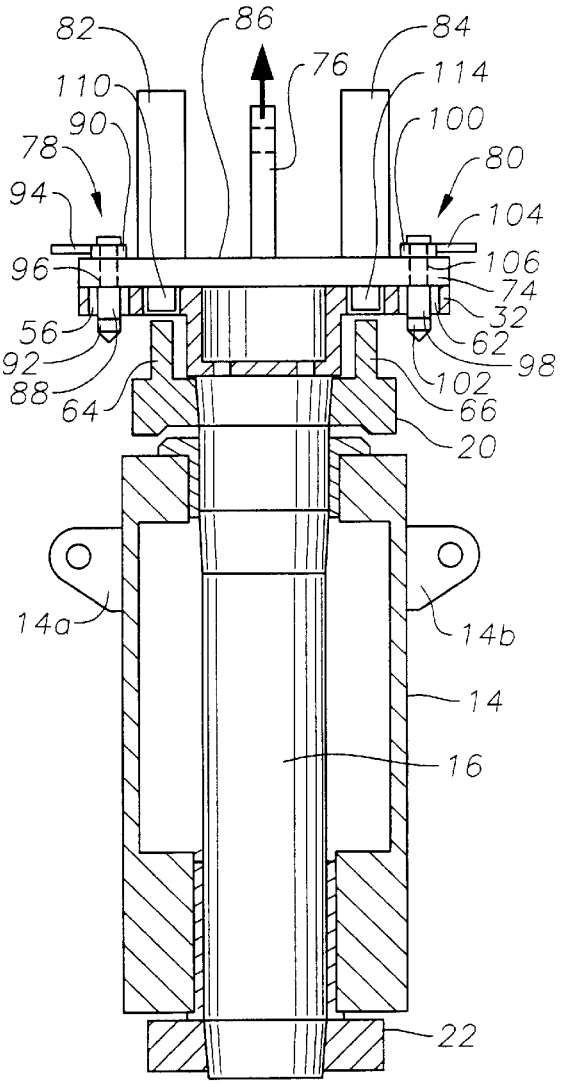
FIG. 10 is a view similar to FIG. 9 showing the strongback engaged to the pivot pin retainer.

Having described the strongback 72, its method of use will now be described. Referring to FIG. 8, the next step is to connect the strongback 72 to the pivot pin retainer 32. The connector arm 76 on the strongback 72 is connected to a deck-mounted chain puller messenger line (not shown) which is used to lower the strongback 72 into engagement with the pivot pin retainer 32. As best shown in FIGS. 9 and 10, the strongback 72 is lowered such that: the first main shaft 88 and the first flange 92 of the first twistlock 78 are inserted through the first twistlock aperture 56 on the pivot pin retainer 32; the first telescoping cylinder 110 of the first hydraulic ram 82 (which, at this time, is in its fully-retracted position) is inserted into the first hydraulic ram aperture 58; the second telescoping cylinder 114 of the second hydraulic ram 84 (which, at this time, is also in its fully-retracted position) is inserted into the second hydraulic ram aperture 60; and the second main shaft 98 and the second flange 102 of the second twistlock 80 are inserted through the second twistlock aperture 62 on the pivot pin retainer 32. The first and second lever arms 94 and 104 on the first and second twistlocks 78 and 80 are then rotated to fasten the strongback 72 to the pivot pin retainer 32, and, thus, to the pivot pin 16. Once this engagement is made, it is conceivable that the pivot pin 16 could be removed by simply pulling up on the strongback 72 with the messenger chain (not shown). However, in practice, it is very likely that the pivot pin 16 will need to be forced apart. This is where the hydraulic rams 82 and 84 come into play.

Figure 11:
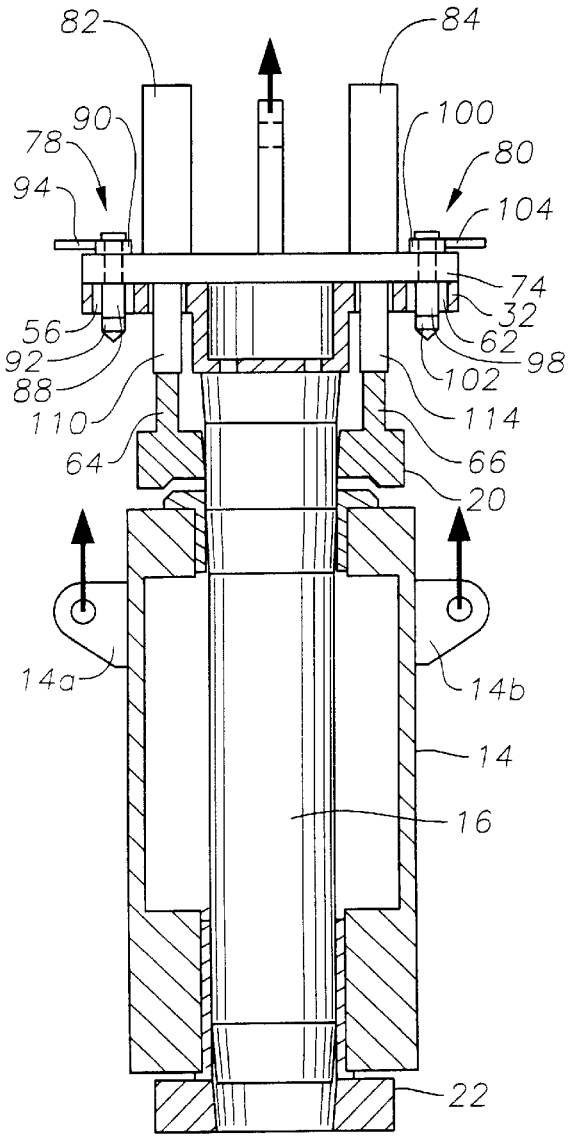
FIG. 11 is a view similar to FIGS. 9 and 10 showing how telescoping cylinders on hydraulic rams that are mounted on the strongback are used to break the pivot pin loose from the fairlead body and from the foundation supports on the support column.
Figure 12:
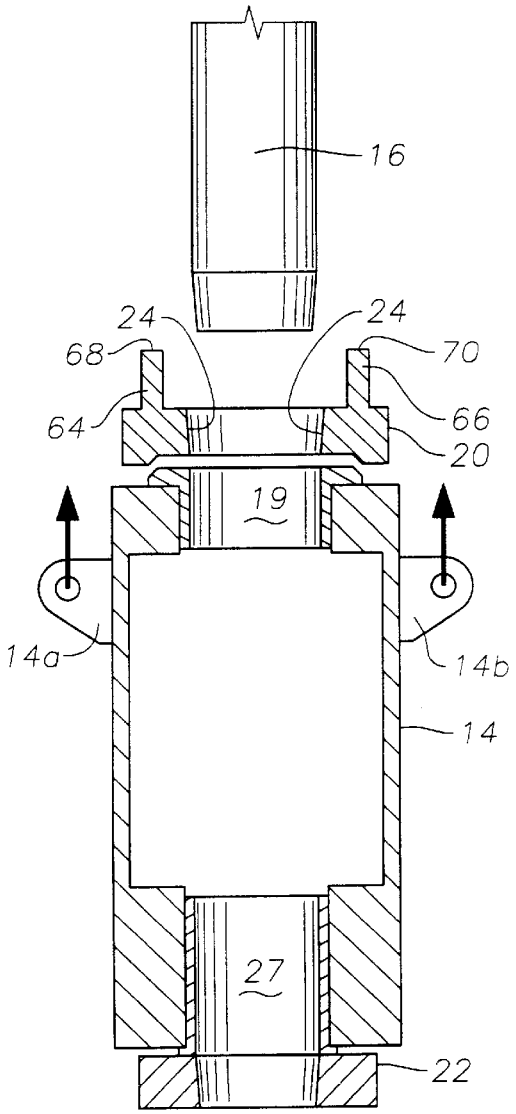
FIG. 12 is a view similar to FIGS. 9 to 11 showing the pivot pin being removed from the fairlead body and from the foundation supports.

Referring now to FIG. 11, the first and second hydraulic rams 82 and 84 are actuated to cause the telescoping cylinders 110 and 114 to move downwardly into contact with the landing surfaces 68 and 70 on the upstanding members 64 and 66 of the first foundation support 20. Hydraulic pressure is applied until the cylinders 110 and 114 break the pivot pin 16 loose so that it may be pulled upwardly to disengage the fairlead body 14 from the foundation supports 20 and 22 and from the fairlead body 14. The pivot pin 16 may be retrieved to the surface and disconnected from the strongback 72, or simply be left hanging in the water above the foundation support 20. Once the pivot pin 16 has been removed, the crane (not shown) on the platform (not shown) may be used to lift the fairlead body 14 away from the foundation supports 20 and 22 and to the platform (not shown) for repair at any location convenient to the operator. After the fairlead body 14 has been repaired, the next step is to reinstall it. The reinstallation process will now be explained with reference to FIGS. 13 to 16.

Figure 13:
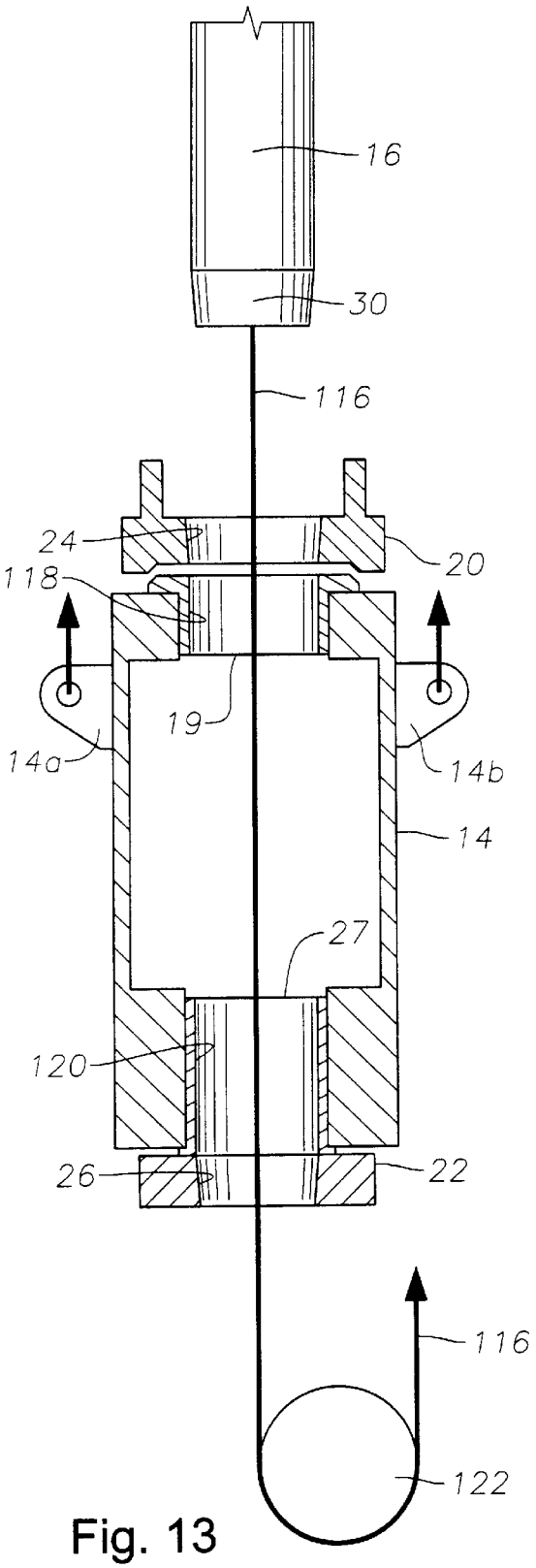
FIG. 13 shows how a wire rope tag line may be connected to the pivot pin to pull it into position during the process of reinstalling the fairlead body after it has been repaired.
Figure 14:
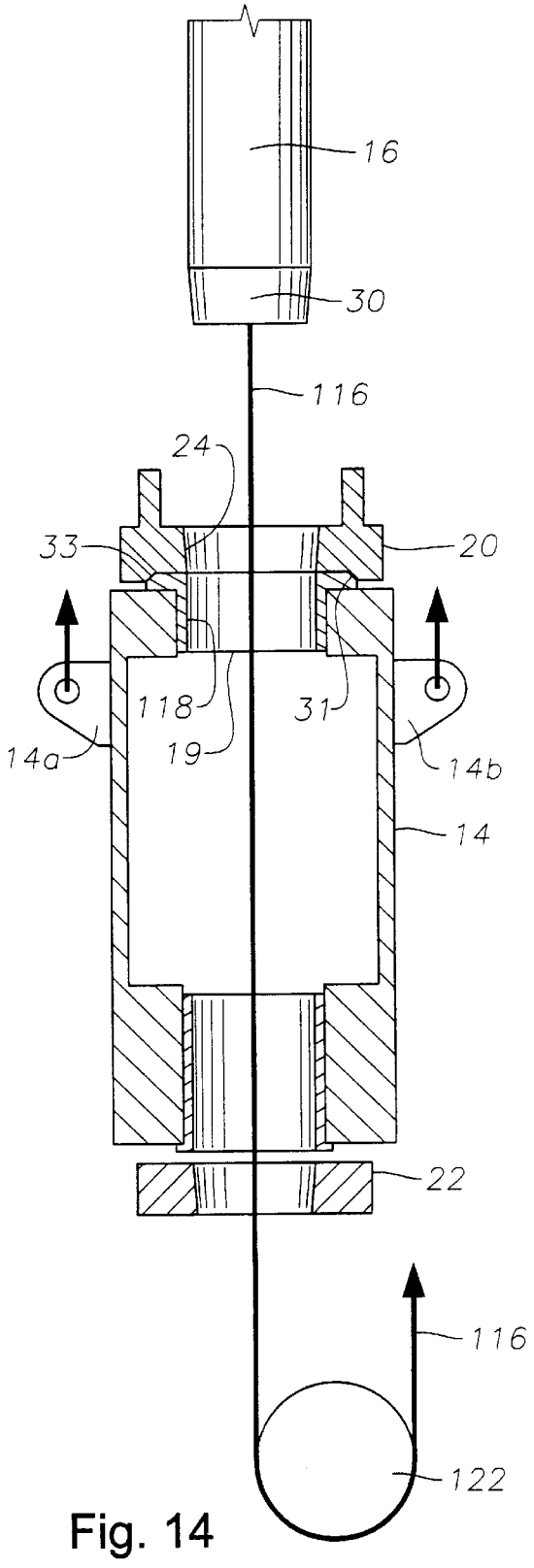
FIG. 14 is a view similar to FIG. 13 showing how the fairlead body is raised upwardly to properly align the fairlead body in relation to the foundation supports before the pivot pin is lowered and pulled into position.
Figure 15:
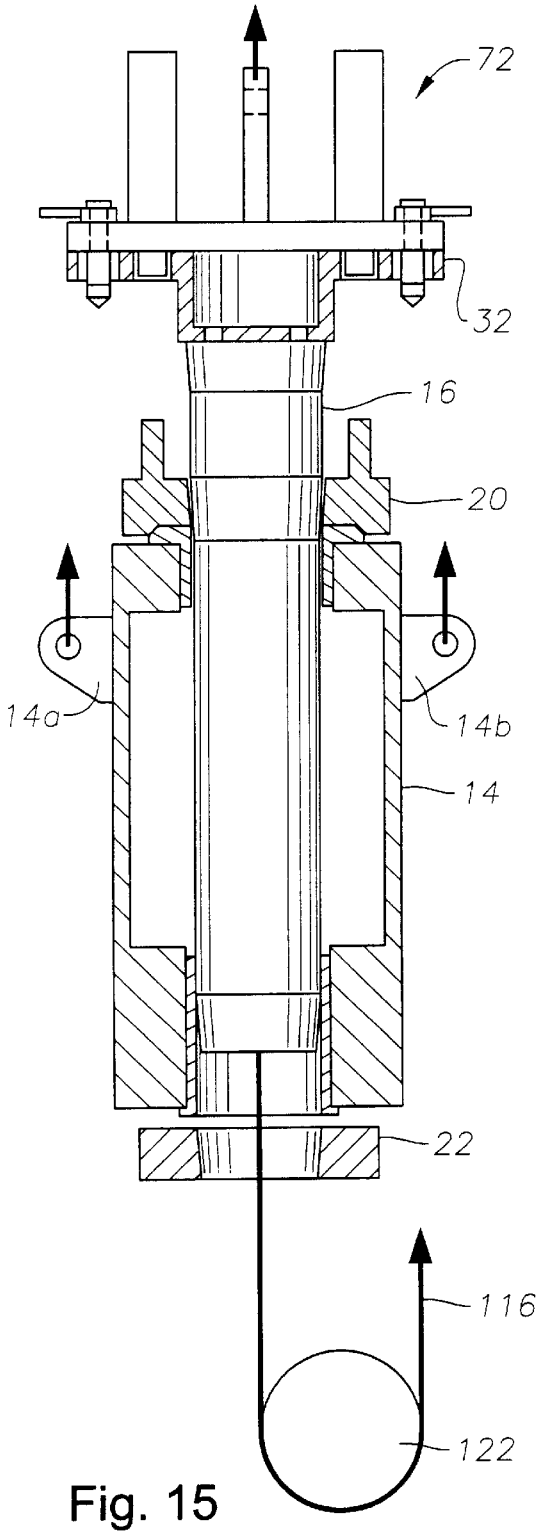
FIG. 15 is a view similar to FIGS. 13 and 14 showing the pivot pin being lowered and pulled into position.
Figure 16:
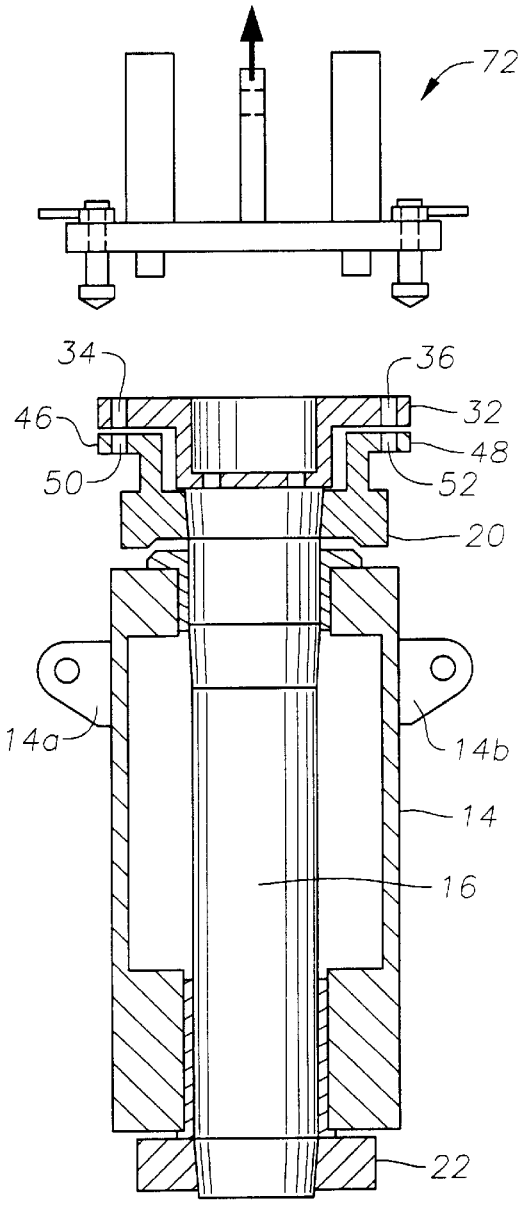
FIG. 16 is a view similar to FIGS. 13 to 15 showing the strongback being retrieved and the pivot pin after it has been properly positioned so as to reinstall the fairlead body between the foundation supports.

If the pivot pin 16 and pivot pin retainer 32 were disconnected from the strongback 72 during the removal process, the pivot pin retainer 32 should be locked to the strongback 72, in the manner discussed above. The crane (not shown) should be used to lower the fairlead body 14 into the water and to position the fairlead body 14 between the foundation supports 20 and 22, as shown in FIG. 13. The strongback 72 and chain messenger line (not shown) are used to lower the pivot pin 16 into position. A wire rope tag line 116 is connected to the second end 30 of the pivot pin 16, passed through the pivot pin bore (the pivot pin bore may be defined by the first aperture 24 in the first foundation support 20, a first bushing bore 118 in the first bushing 19, a second bushing bore 120 in the second bushing 27, and the second aperture 26 in the second foundation support 22), around a sheave 122 mounted to the support column 12 below the second foundation support 22, and up to a deck crane (not shown). Before the pivot pin 16 is pulled through the pivot pin bore with the tag line 116, the fairlead body 14 may be lifted upwardly, as shown in FIG. 14, to align, or center, the first aperture 24 in the first foundation support 20 with the first bushing bore 118 in the first bushing 19 so that the pivot pin 16 will fit into the pivot pin bore. This alignment takes place because the recessed surface 29 of the first foundation support 20 is provided with its first inclined surface 31, as identified previously in connection with the above discussion of FIGS. 3 and 4, which is designed to mate with the second inclined surface 33 on the tapered flange 21 of the first bushing 19. Accordingly, as the fairlead body 14 is lifted upwardly, the interaction of the first and second inclined surfaces 31 and 33 guide the first aperture 24 in the first foundation support 20 into alignment with the first bushing bore 118 in the first bushing 19. After this alignment step, the next step, as illustrated in FIG. 15, is to use the tag line 116 to pull the pivot pin 16 into position. Once the pivot pin 16 is properly positioned, as shown in FIG. 16, the strongback 72 is disconnected from the pivot pin retainer 32, and the pivot pin retainer 32 is locked to the first foundation support 20 by use of the clamp bolts 35 and 37, as shown in FIG. 5 and as explained above in connection with FIG. 3. More particularly, with reference to FIG. 3 and 16, the first clamp bolt 35 is inserted through the first clamp bolt aperture 34 in the pivot pin retainer 32 and through the third clamp bolt aperture 50 in the first flange 46 on the first foundation support 20. Similarly, the second clamp bolt 37 is inserted through the second clamp bolt aperture 36 in the pivot pin retainer 32 and through the fourth clamp bolt aperture 52 in the second flange 48 on the first foundation support 20. Finally, the crane (not shown) that was used to lower the fairlead body 14 into position, and to hold it there, may now be disconnected from the attachment arms 14*a* and 14*b* on the fairlead body 14.

Second Embodiment

Another embodiment of the fairlead method and apparatus of the present invention will now be explained with reference to FIGS. 17 to 26. As will be seen, the first and second embodiments have some components in common; reference numerals in the second embodiment corresponding to those common components will be primed. As will become apparent upon reading the following description, the primary difference between the above-discussed first embodiment and the below-discussed second embodiment relates to the structure of the first (or upper) foundation support 20/20' and the manner in which the pivot pin 16/16' is removed and reinstalled; as will be seen, the second embodiment uses a jack screw assembly, whereas the first embodiment uses the strongback 72.

Figure 17:
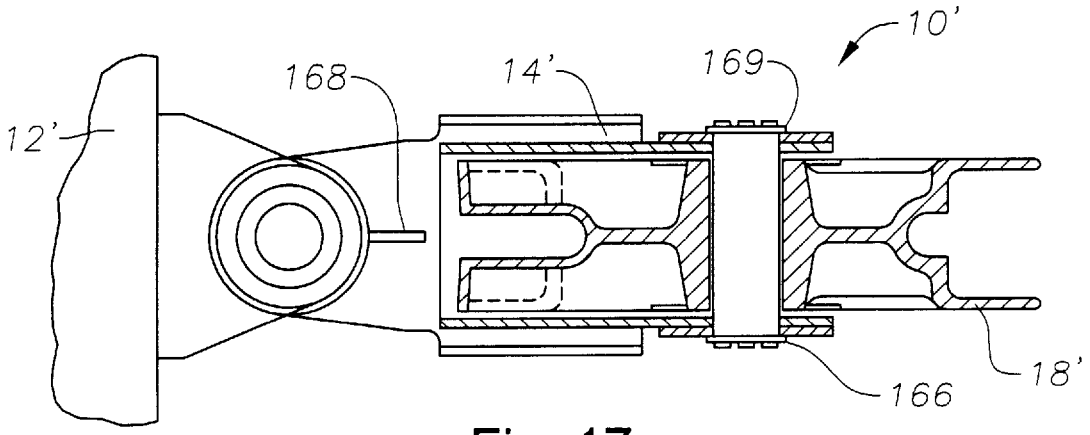
FIG. 17 is a top view of an alternative embodiment of the fairlead of the present invention.
Figure 18:
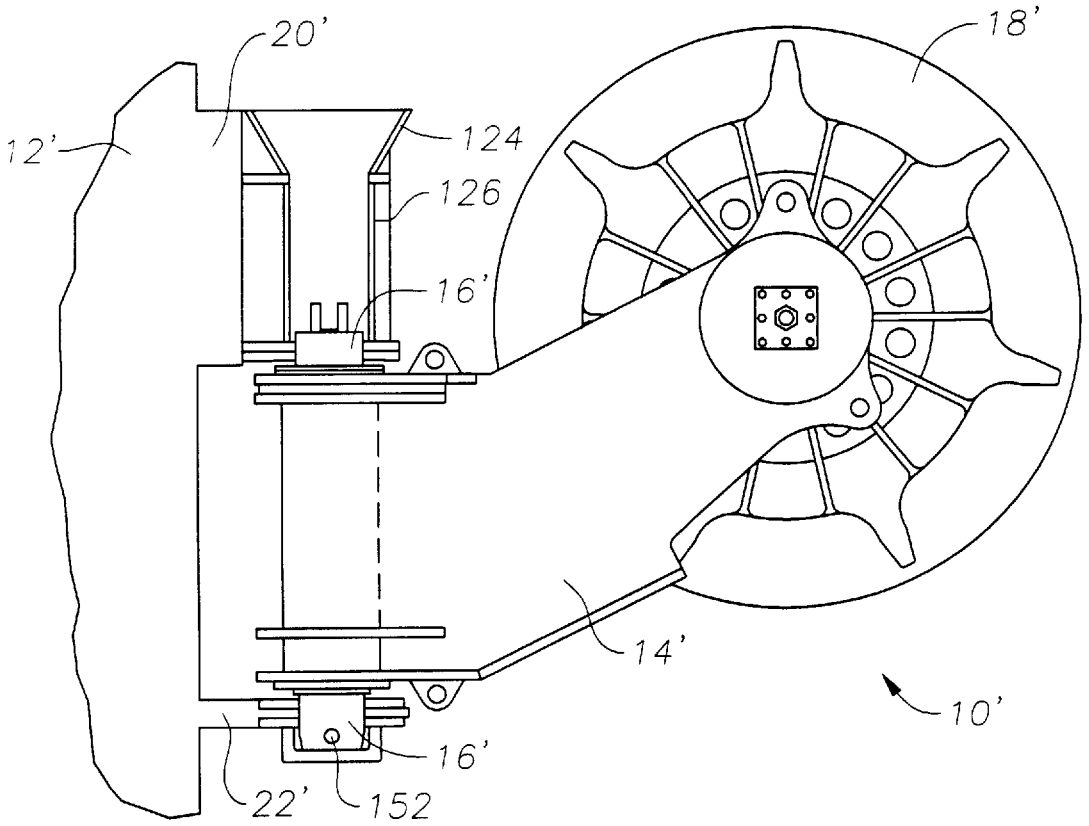
FIG. 18 is a side elevational view of the fairlead as shown in FIG. 17.
Figure 19:
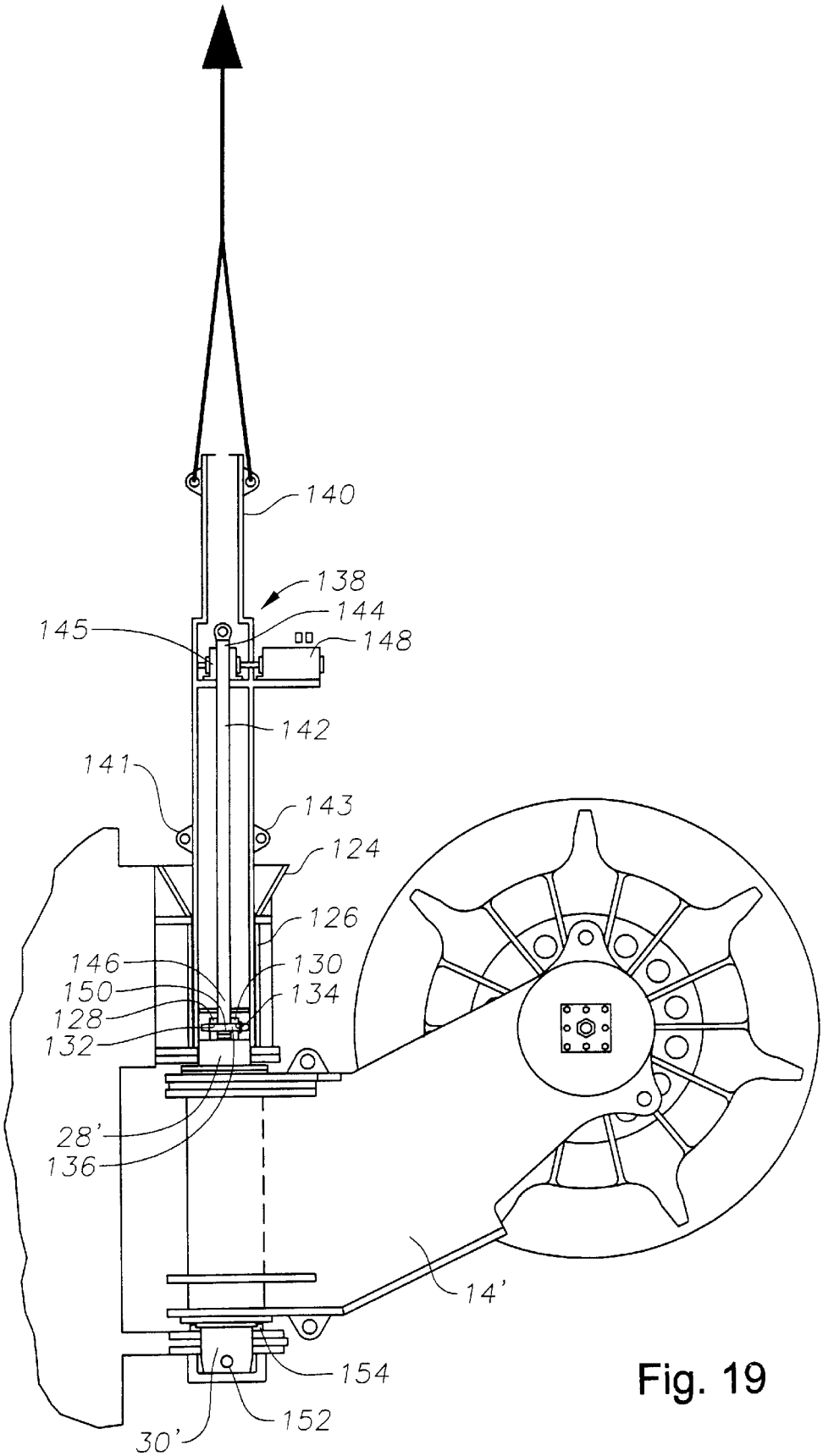
FIG. 19 is a side elevational view of the fairlead shown in FIGS. 17 and 18 and further illustrating a pivot pin jack that has been positioned to remove the pivot pin to release the fairlead body.

Referring initially to FIGS. 17 and 18, which depict a top and side elevation view, respectively, of this embodiment of the invention, there is shown a fairlead 10' attached to a support column 12'. The fairlead 10' may broadly include: a fairlead body 14'; and a pivot pin 16'. A sheave or pulley 18' is rotatably mounted to the fairlead body 14'. The support column 12' includes a first fairlead foundation support 20' and a second fairlead foundation support 22'. The first foundation support 20' may include a funnel-shaped jack socket 124 and a guiding sleeve 126. Referring to FIG. 19, it can be seen that the first end 28' of the pivot pin 16' includes a first upstanding mounting arm 128 and a second upstanding mounting arm 130. The first mounting arm 128 includes a first locking bore 132, and the second mounting arm 130 includes a second locking bore 134. The locking bores 132 and 134 are arranged so as to receive a locking pin 136, the function of which will be explained shortly.

Figure 21:
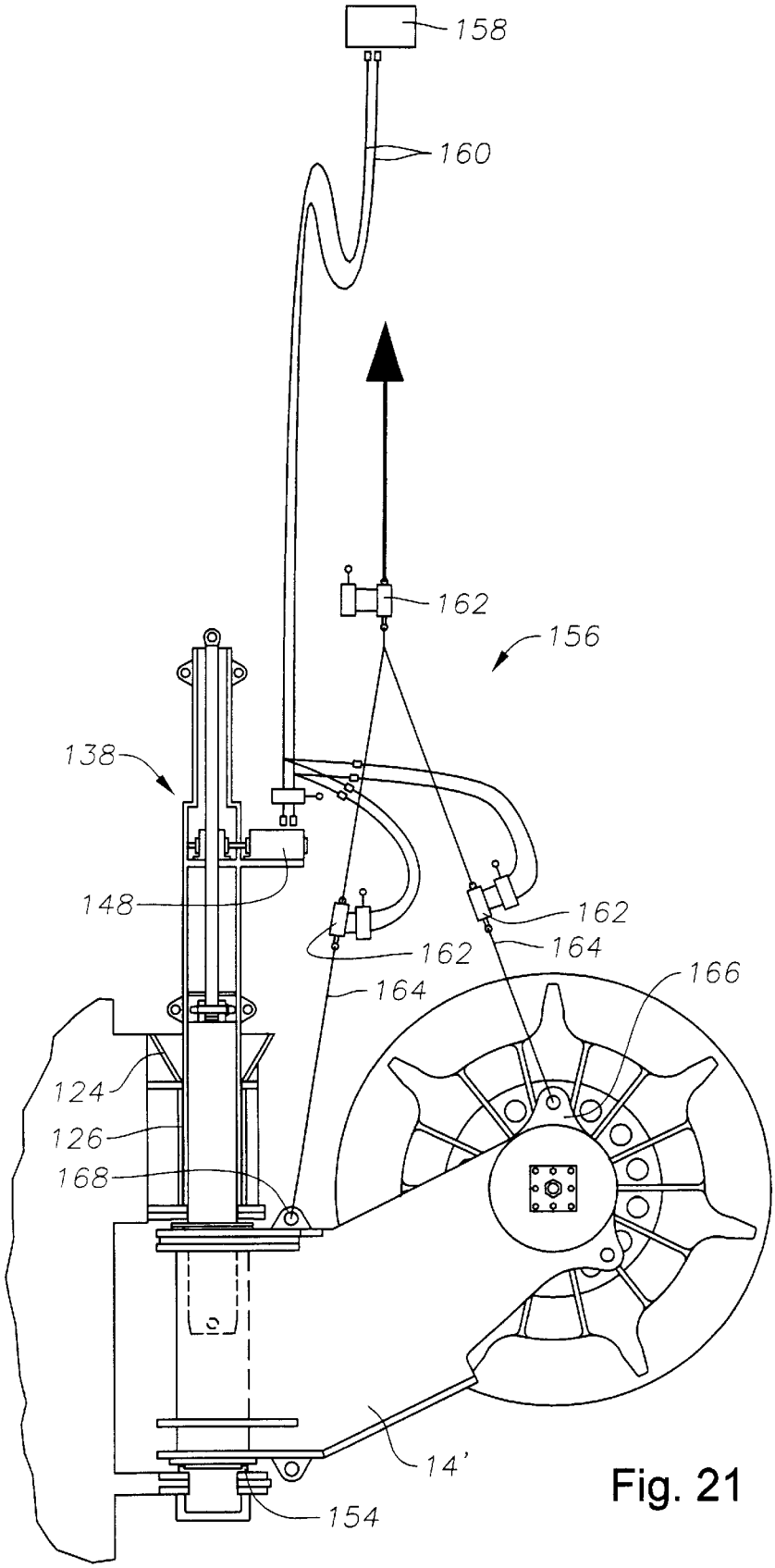
FIG. 21 is a view similar to FIG. 19 showing the pivot pin being removed.
Figure 20:
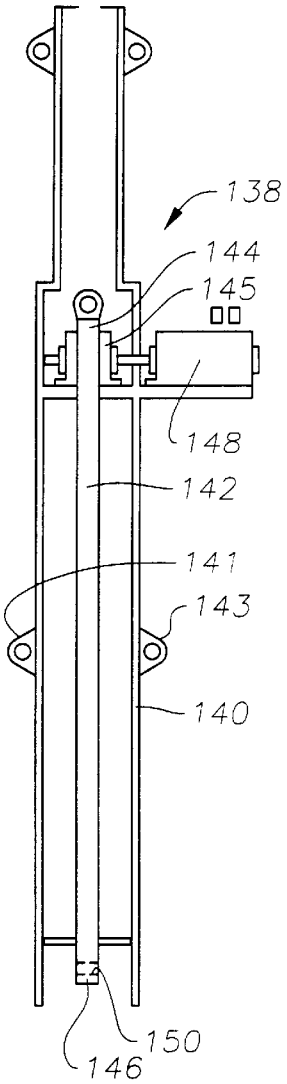
FIG. 20 shows the pivot pin jack by itself.

FIG. 19 further illustrates a pivot pin jack 138, which may include a housing 140, a jack screw 142 having a first end 144 and a second end 146, a gear box 145, and a motor 148. The pivot pin jack 138 is also shown by itself in FIG. 20. The jack screw 142 and gear box 145 may be provided as an assembly, such as those of the type available from Joyce, of Dayton, Ohio, such as Model No. WJ-3225 or WJ-1125. In a specific embodiment, the motor 148 may be a hydraulic motor of the type manufactured by Eaton Corporation, of Prairie, Minn., under the name Char-Lynn, such as Model No. 104-1002. Some means of energizing the motor 148 should be provided. This may be done by running a power line (not shown) from the platform (not shown) to the motor 148. If the motor 148 is a hydraulic motor, then the power line from the surface (not shown) would be a hydraulic control line. With reference to FIG. 21, power may also be supplied to the motor 148 by providing a power pack 158 and connecting one or more power lines 160 from the power pack 158 to the motor 148. The power pack 158 may be mounted to the support column 12. The specifics of the power pack 148 will depend upon the type of motor 148 being used. If the motor 148 is a hydraulic motor, then the power pack 158 will be of the type well know to those of ordinary skill in the art that will generate pressurized fluid for transmitting through the power lines 160, which may be hydraulic lines, to the motor 148. In a specific embodiment, the power pack 158 may be of the type available from Oilgear, of Novi, Minn., having the following specifications: 12 GPM, 1800 p.s.i., 20 horsepower motor w/filter, 4-way valve, and a fluid reservoir. The housing 140 may be provided with a first anchoring ear 141 and a second anchoring ear 143. The jack screw 142 is disposed for longitudinal movement within the housing 140. The motor 148 is coupled to the jack screw 142 through the gear box 145 in any known manner so as to provide power to move the jack screw 142 up and down within the jack housing 140. The second end 146 of the jack screw 142 includes a connecting bore 150 for receiving the locking pin 136, as will be described more fully hereinafter. The second end 30' of the pivot pin 16' may be provided with a retainer pin 152 to prevent the pivot pin 16' from becoming dislodged during operation of the fairlead 10'. The second foundation support 22' may include a pivot pilot seat 154 on which the fairlead body 14' will rest, and which will also assist in properly aligning the pivot pin bore in the fairlead body 14' during the installation process.

Figure 25:
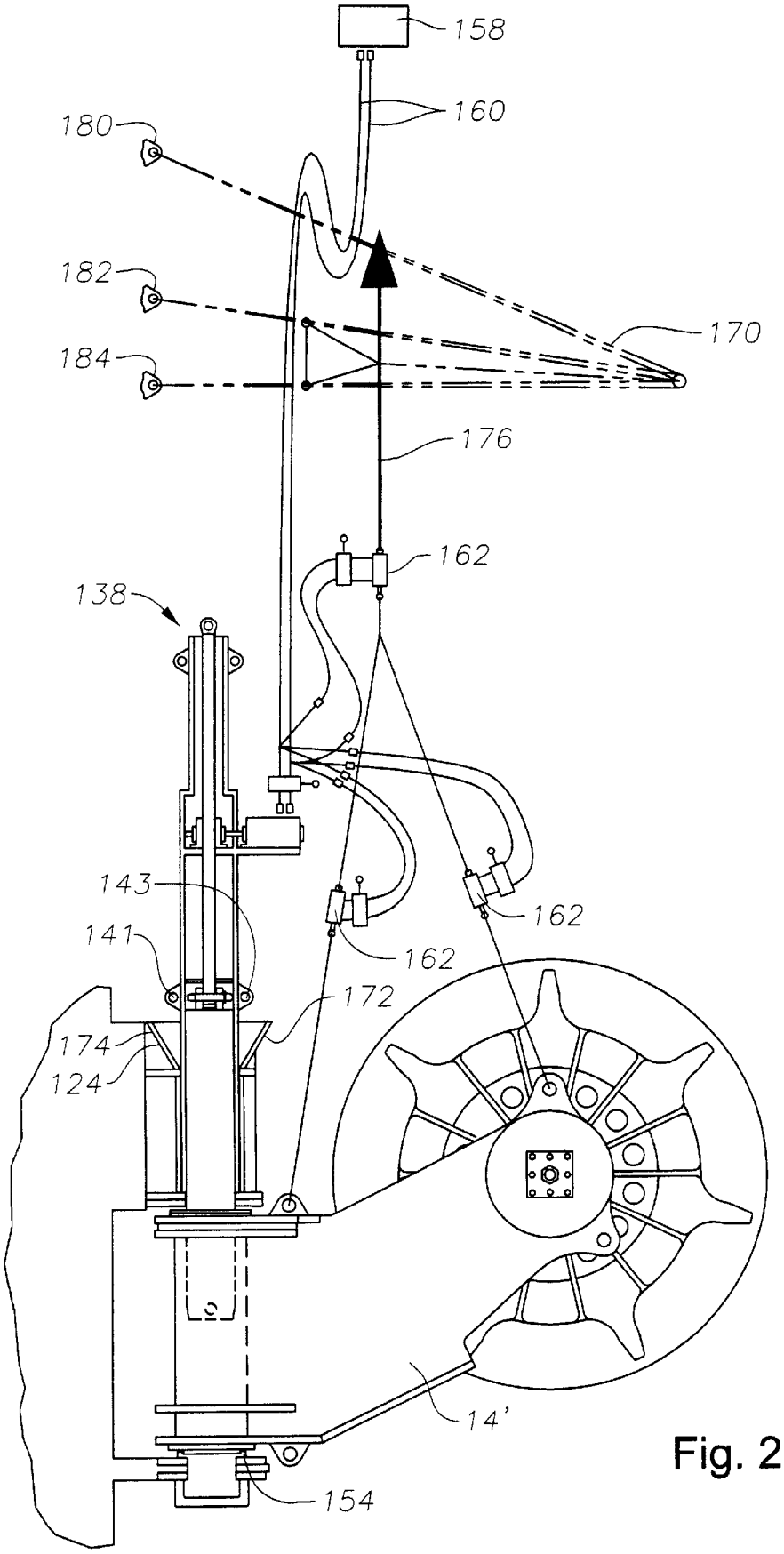
FIG. 25 is a side elevational view showing the fairlead body after it has been positioned between the first and second foundation support and further showing the pivot pin being installed with the use of the pivot pin jack.
Figure 26:
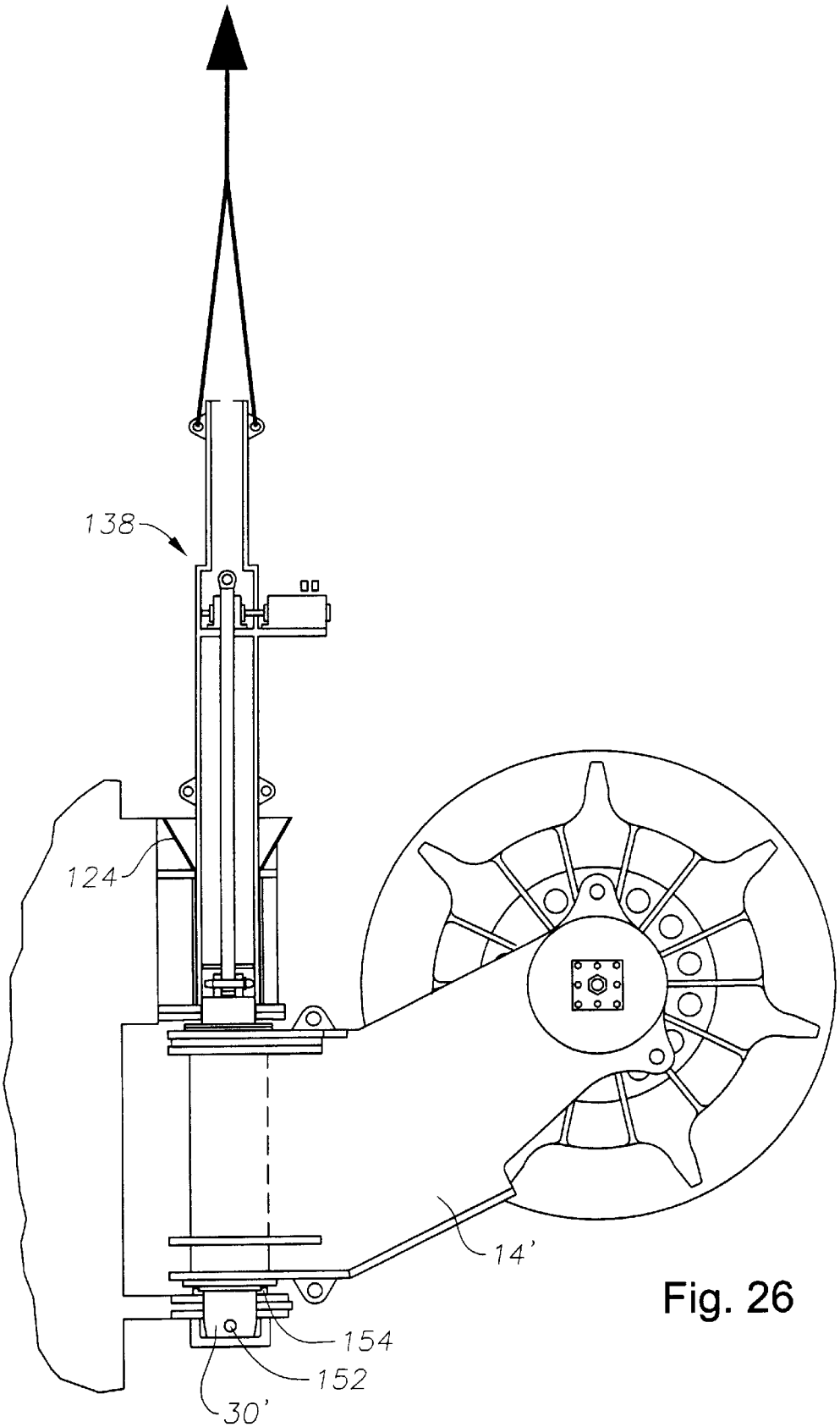
FIG. 26 is a side elevational view showing the fairlead body after it has been reinstalled but before the pivot pin jack has been disconnected from the pivot pin and retrieved to the surface.

In this alternative embodiment of the present invention, when the fairlead body 14' is in need of repair, the first step in the process of detaching the fairlead body 14' from the foundation supports 20' and 22' is to use a deck crane (not shown) to lower the pivot pin jack 138 into the jack socket 124 and into the guiding sleeve 126 until the jack 138 bottoms out just above the pivot pin 16' on the first foundation support 20'. The jack screw 142 is then coupled to the pivot pin 16' by: positioning the second end 146 of the jack screw 142 between the first and second upstanding mounting arms 128 and 130 on the first end 28' of the pivot pin 16'; aligning the connecting bore 150 in the second end 146 of the jack screw 142 with the first and second locking bores 132 and 134 in the first and second mounting arms 128 and 130, respectively; and inserting the locking pin 136 through the aligned bores 132, 150, and 134. Next, the retainer pin 152 in the second end 30' of the pivot pin 16' is removed and the deck crane (not shown) may be disconnected from the jack 138. The jack 138 may be secured to the jack socket 124, by any suitable means as known to one of ordinary skill in the art. With reference to FIG. 25, in a specific embodiment, the jack 138 may be secured to the jack socket 124 by connecting a first shackle and chain assembly (not shown) between the first anchoring ear 141 on the jack housing 140 and a first anchoring aperture 172 on the jack socket 124, and by connecting a second shackle and chain assembly (not shown) between the second anchoring ear 141 and a second anchoring aperture 174 on the jack socket 124. Again, this is just one way in which the jack 138 may be secured to the jack socket 124. The scope of the invention is not to be limited to any particular tie-off arrangement.

Figure 22:
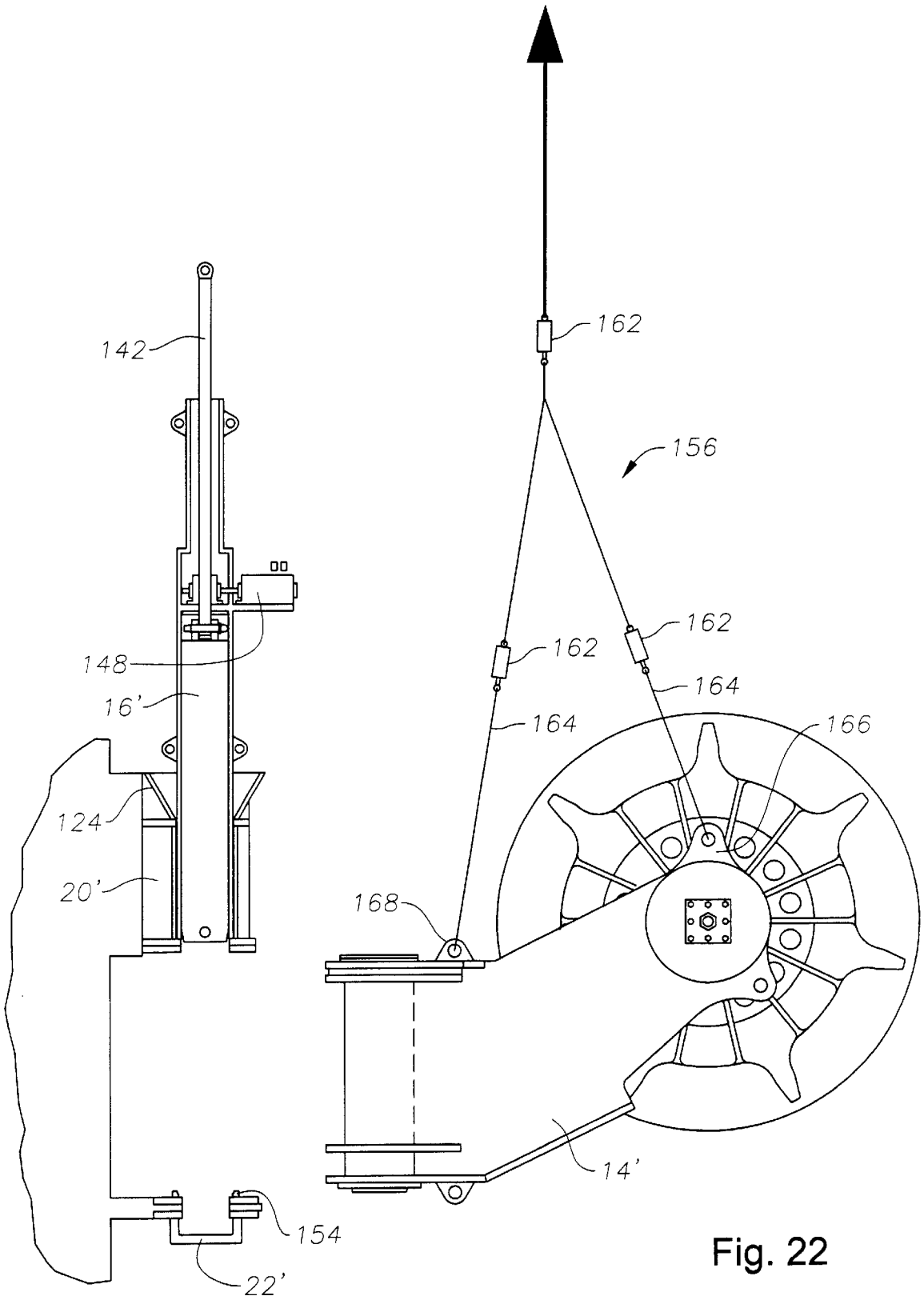
FIG. 22 is a view similar to FIGS. 19 and 21 showing the pivot pin after it has been retracted within the pivot pin jack housing and further showing the fairlead body after it has been moved away from the foundation supports.
Figure 23:
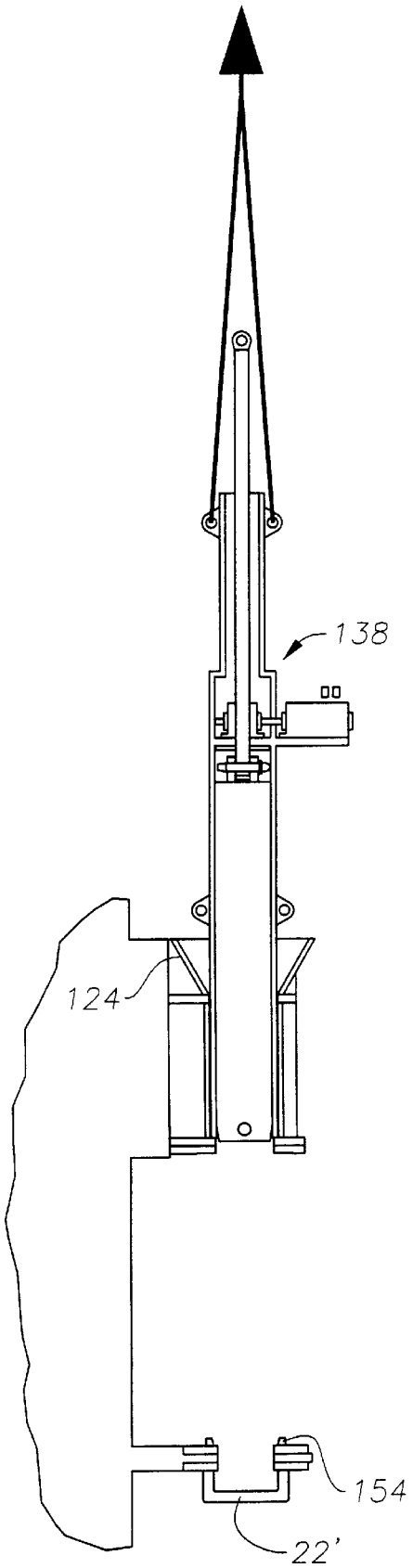
FIG. 23 is a side elevational view showing the pivot pin jack positioned within the first foundation support and illustrating one of the steps in the method of reinstalling the fairlead body.

Next, as shown in FIGS. 21 and 22, a deck crane (not shown) is connected to the fairlead body 14. This connection may be made with an adjustable rigging 156. The adjustable rigging 156 may include one or more adjustable rigging cylinders 162 to control the rigging lines 164 that are connected to the fairlead body 14', as at first and second connecting points 166 and 168. As shown in FIG. 17, the fairlead body 14' includes a third connecting point 169 to which a rigging line (not visible in FIG. 20) is connected. The rigging cylinders 162 may be connected to and powered by the power pack 158. The adjustable rigging 156 and deck crane (not shown) are used initially to raise the fairlead body 14' enough to take the weight of the fairlead body 14' off the second foundation support 22', but not so far as to lift the fairlead body 14' off the pivot pilot seat 154. The power pack 158 is then used to actuate the motor 148 to commence movement of the jack screw 142 to raise the pivot pin 16'. The adjustable rigging 156 and rigging cylinders 162 may be used to align the fairlead body 14' as required to facilitate the removal of the pivot pin 16'. After the pivot pin 16' has been fully withdrawn, as shown in FIG. 21, and the fairlead body 14' is hanging square, the hydraulic lines 160 powering the motor 148 and the rigging cylinders 162 should be disconnected. The crane (not shown) should then be used to lift the fairlead body 14' off the pivot pilot seat 154 and moved away from the foundation supports 20' and 22', as shown in FIG. 22. The fairlead body 14' may then be raised to the platform (not shown) for repair.

The process of reinstalling the fairlead body 14' after it has been repaired will now be explained. A deck crane (not shown) may be used to lower the pivot pin jack 138 into the jack socket 124 and guiding sleeve 126 on the first foundation support 20'. The jack 138 should be secured to the jack socket 124 in the manner discussed above. The crane (not shown) may then be disconnected from the jack 138, and then used to lower the fairlead body 14' and position it adjacent the foundation supports 20' and 22'. The hydraulic lines 160 from the power pack 158 are connected to the rigging cylinders 162. The deck crane (not shown) and the adjustable rigging 156 are then used to position the fairlead body 14' between the foundation supports 20' and 22'; the fairlead body 14' should first be positioned on the pivot pilot seat 154 on the second foundation support 22', and then aligned—by use of the adjustable rigging 156—with the first foundation support 20' so it will receive the pivot pin 16'. The pivot pin jack 138 is then used to lower the pivot pin 16' into position to hold the fairlead body 14' in place. The adjustable rigging 156 may be used as required to facilitate the insertion of the pivot pin 16' into the fairlead body 14'. Once the pivot pin 16' has been fully inserted, the retainer pin 152 is installed in the second end 30' of the pivot pin 16'. The jack screw 142 is disconnected from the pivot pin 16' by removing the locking pin 136 (recall FIG. 19) and by removing the first shackle and chain assembly (not shown) from between the first anchoring ear 141 on the jack housing 140 and the first anchoring aperture 172 on the jack socket 124, and by removing the second shackle and chain assembly (not shown) from between the second anchoring ear 141 and the second anchoring aperture 174 on the jack socket 124. The hydraulic lines 160 should then be disconnected from the motor 148 and from the adjustable rigging cylinders 162. The deck crane (not shown) may then be disconnected from the fairlead body 14' and used to retrieve the jack 138 to the surface.

Figure 24:
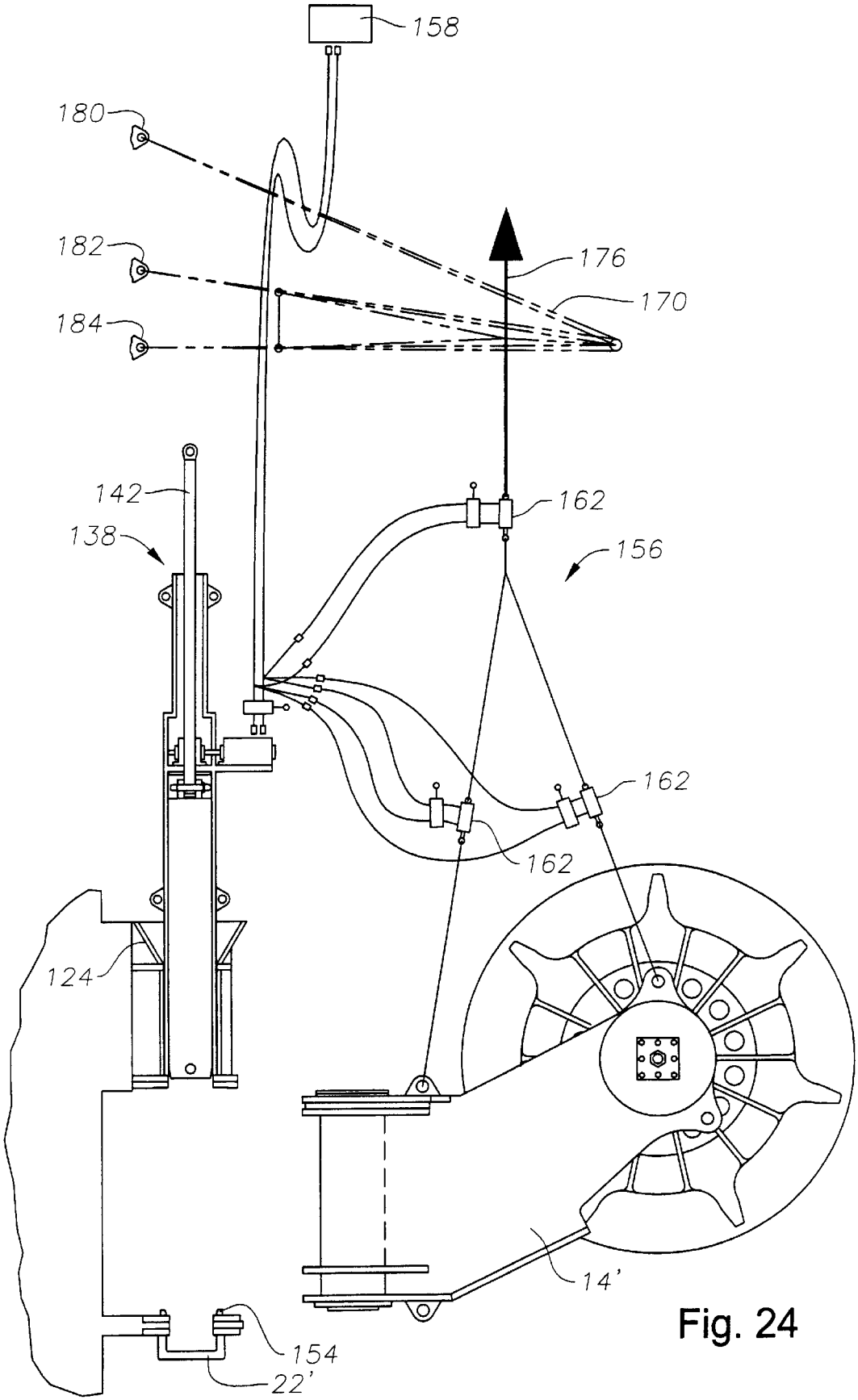
FIG. 24 is a side elevational view showing the fairlead body as it is being reinstalled.

Referring to FIGS. 24 and 25, there is shown a rigging positioning frame 170 that may be useful when reinstalling the fairlead body 14' in water having significant currents, the function of the positioning frame being to prevent such water currents from causing the fairlead body 14' to swing or oscillate as it is being lowered down to the foundation supports 20' and 22'. It should be noted that the rigging positioning frame 170 may be used with either the first or second embodiment of the present invention. The rigging positioning frame 170 is a triangular frame that is secured to the support column 12' above the first foundation support 20', as at connecting points 180, 182, and 184, and is positioned around a crane line 176 to which the adjustable rigging 156 is connected. The positioning frame 170 is not placed about the crane line 176 until after the fairlead body 14' has been lowered past the positioning frame 170. Once the fairlead body 14' has been lowered past the positioning frame 170, the crane line 176 is manually positioned within the triangular positioning frame 170 so as to prevent currents from causing the fairlead body 14' to swing or oscillate. Separate lines may be connected from each comer of the triangular frame 170, either directly to the crane line 176 or to a shackle disposed about the crane line 176, to more closely control the position of the crane line 176 and the fairlead body 14'. In another embodiment, additional positioning frames (not shown) may be spaced along the length of the support column 12' between the first foundation support 20' and the water surface (not shown) as further means of preventing any swinging of the fairlead 14' when being lowered in strong water currents.

Figure 27:
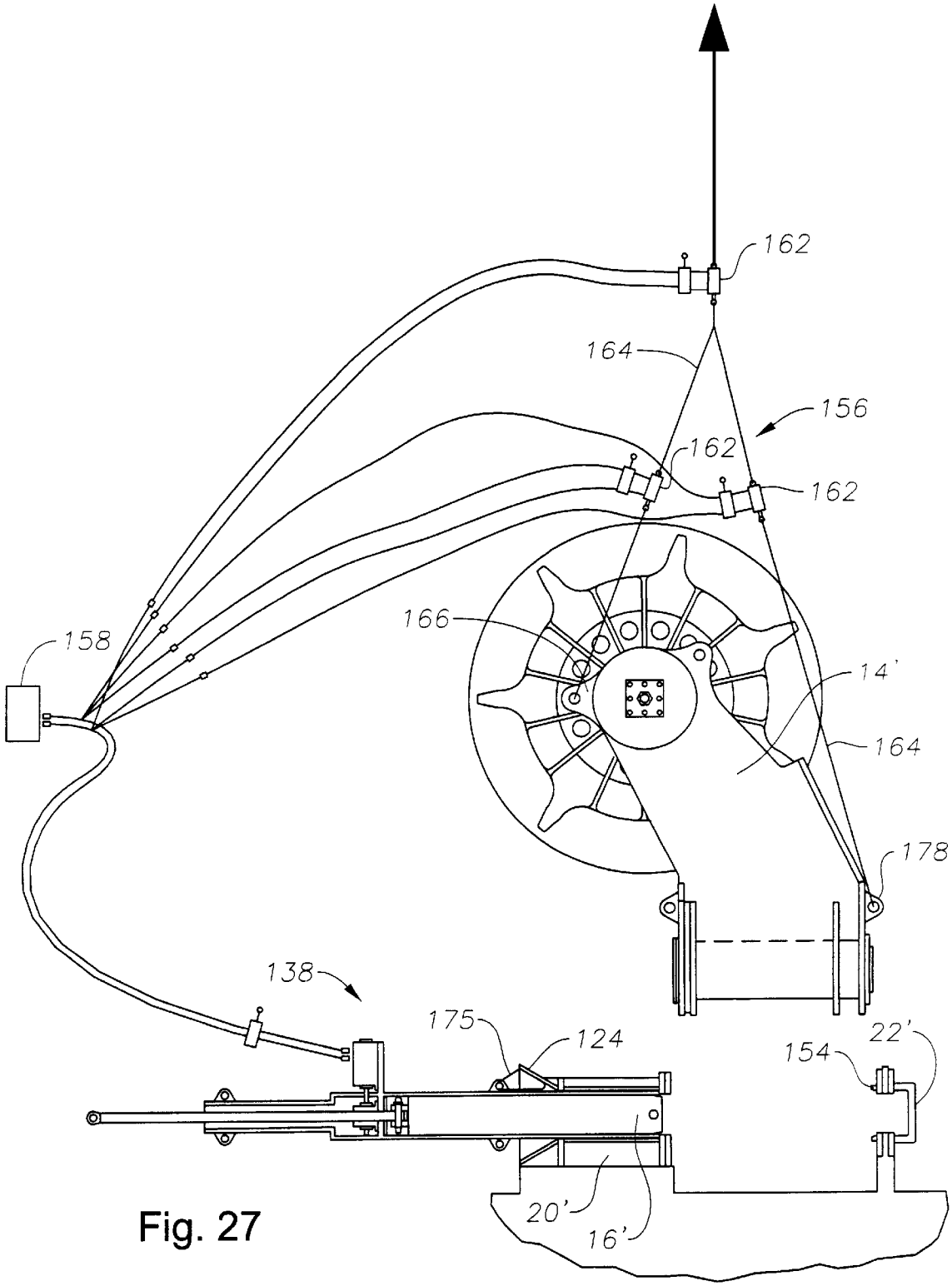
FIG. 27 is a side elevational view showing the fairlead body being installed during the process of manufacturing the drilling or production vessel, at which time the support column is horizontal instead of vertical.
Figure 28:
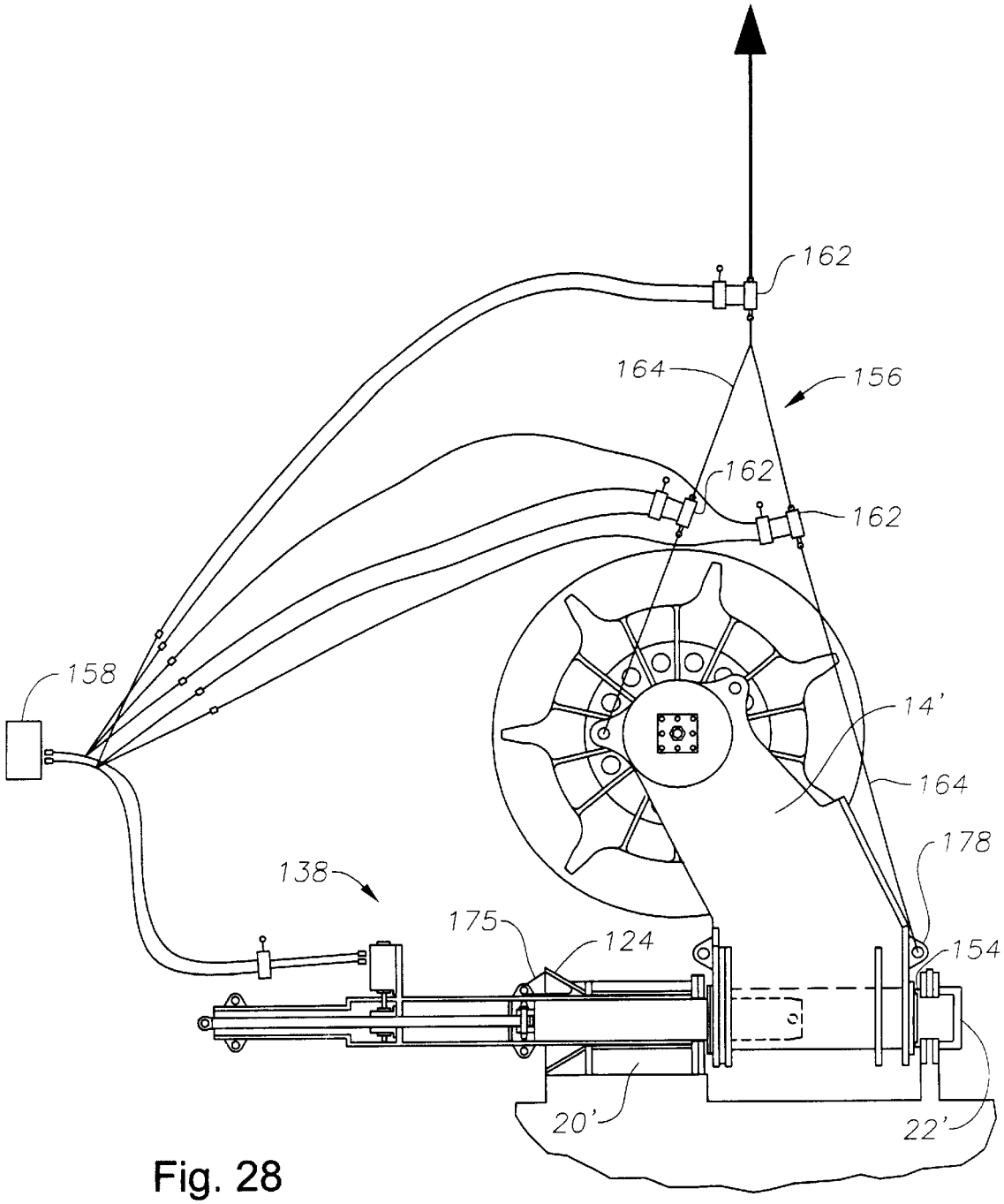
FIG. 28 is a view similar to FIG. 27 showing the pivot pin in the process of being inserted into the pivot pin bore of the fairlead body.
Figure 29:
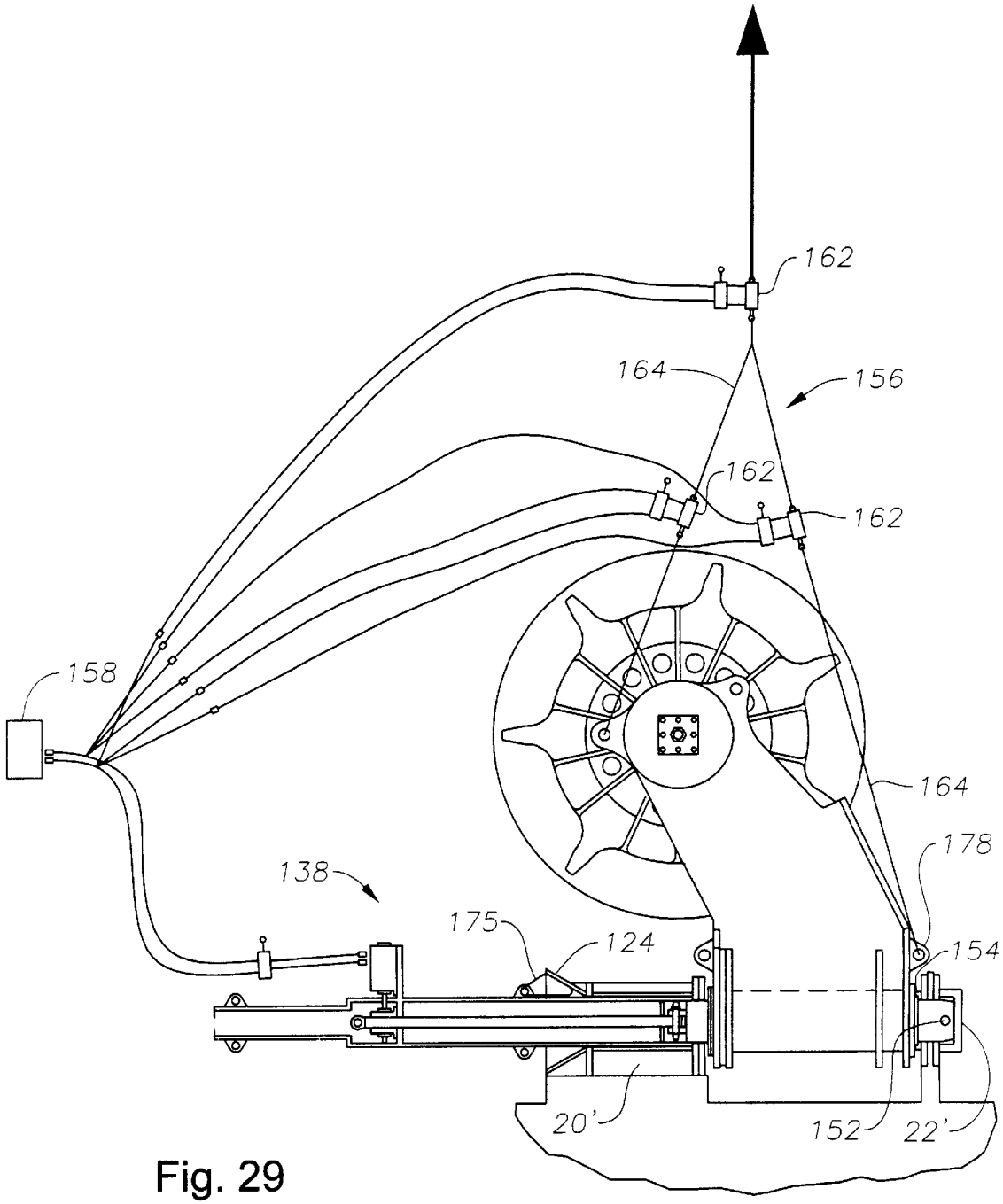
FIG. 29 is a view similar to FIGS. 27 and 28 showing the pivot pin after it has been inserted into the pivot pin bore of the fairlead body and secured thereto with a retainer pin.

The present invention further includes a method of installation during the manufacturing process, which will now be explained with reference to FIGS. 27 to 29. As can be seen from FIGS. 27–29, during the manufacturing process, the support column (not shown) to which the foundation supports 20' and 22' are attached, is in a horizontal position. The jack 138, with the pivot pin 16' retained therein, should be positioned in the jack socket 124 and guiding sleeve 126. The jack 138 should also be secured to the jack socket 124 in any suitable manner, such as the manner described above, or as indicated in FIGS. 27–29 by the reference numeral 175. A crane (not shown) should then be used to lift the fairlead body 14' into position between the first and second foundation supports 20' and 22'. The crane (not shown) should be connected to the fairlead body 14' via the adjustable rigging 156 in the same manner discussed above, with the following exception: instead of connecting one of the rigging lines 164 to the second connecting point 168 on the fairlead body 14', it should be connected to a fourth connecting point 178 on the fairlead body 14', as shown in FIGS. 27–29. The adjustable rigging 156 may be used in the manner explained above to properly align the fairlead body 14' between the foundation supports 20' and 22' to permit the insertion of the pivot pin 16' into the pivot pin bore of the fairlead body 14'. Once inserted, the pivot pin 16' should be secured by use of the retainer pin 152 (see FIG. 29) in the same manner as discussed above. The jack screw 142 should be disconnected from the pivot pin 16' in the same manner as discussed above. The pivot pinjack 138 should be removed in the same manner as discussed above. Finally, the fairlead 10' should be tied off to prevent movement during transportation.

Third Embodiment

Another specific embodiment of the fairlead method and apparatus of the present invention will now be explained with reference to FIGS. 30 to 39. As will be seen, the first, second and third embodiments have some components in common; however, reference numerals will be different for the third embodiment. Unlike the second embodiment, which utilizes a jack screw assembly, the third embodiment utilizes a modified strongback 372 compared to the strongback 72 in either the first or second embodiment, and different method of reinstallation of the pivot pin 16/16'/316 than utilized in either the first or second embodiment.

Figure 30:
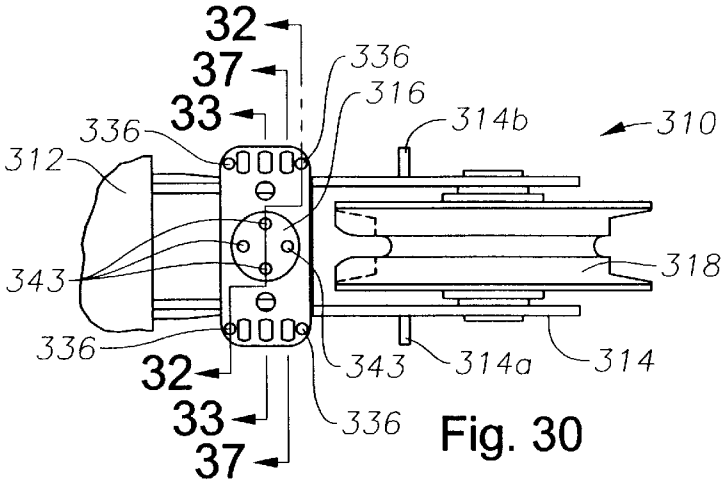
FIG. 30 is a top view of the fairlead of a specific embodiment of the invention.
Figure 31:
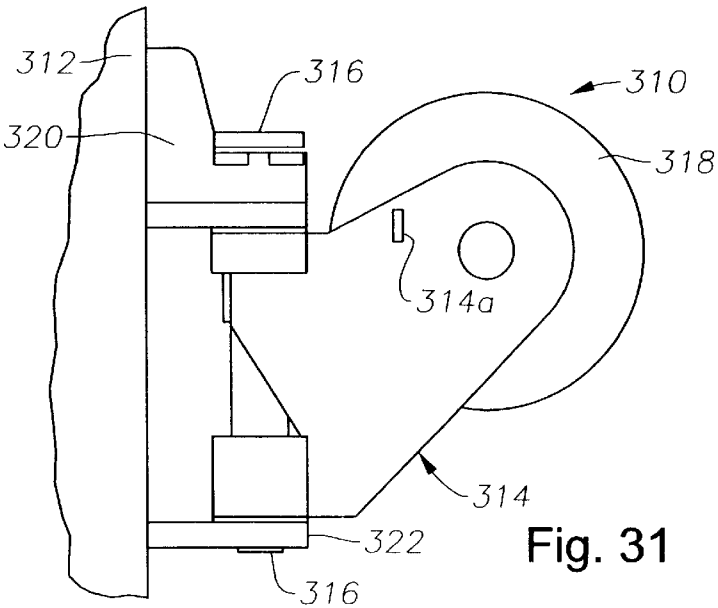
FIG. 31 is a side elevational view of the fairlead shown in FIG. 30.

Referring now to FIGS. 30 and 31, there is shown a top and elevation view, respectively, of a fairlead 310 attached to a support column 312, or DDCV, of an offshore drilling and/or production vessel (not shown), such as a spar-type vessel. The fairlead 310 may broadly include: a fairlead body 314; and a pivot pin 316. A sheave or pulley 318 is rotatably mounted to the fairlead body 314. As shown in FIG. 31, the support column 312 includes a first fairlead foundation support 320 and a second fairlead foundation support 322.

Figure 32:
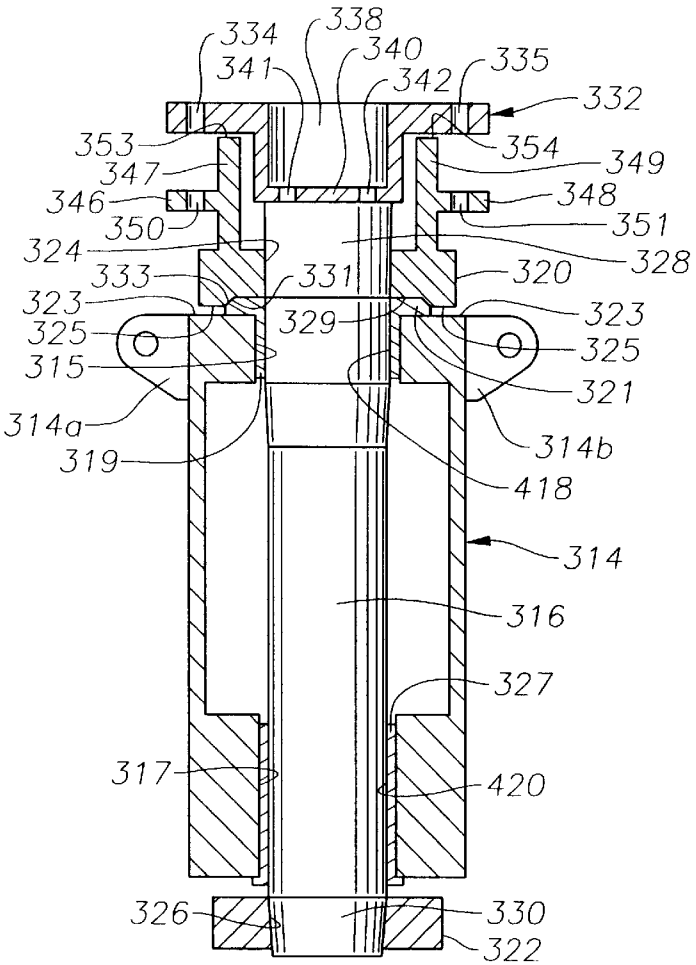
FIG. 32 is a cross-sectional view taken along line 32—32 of FIG. 30.
Figure 33:
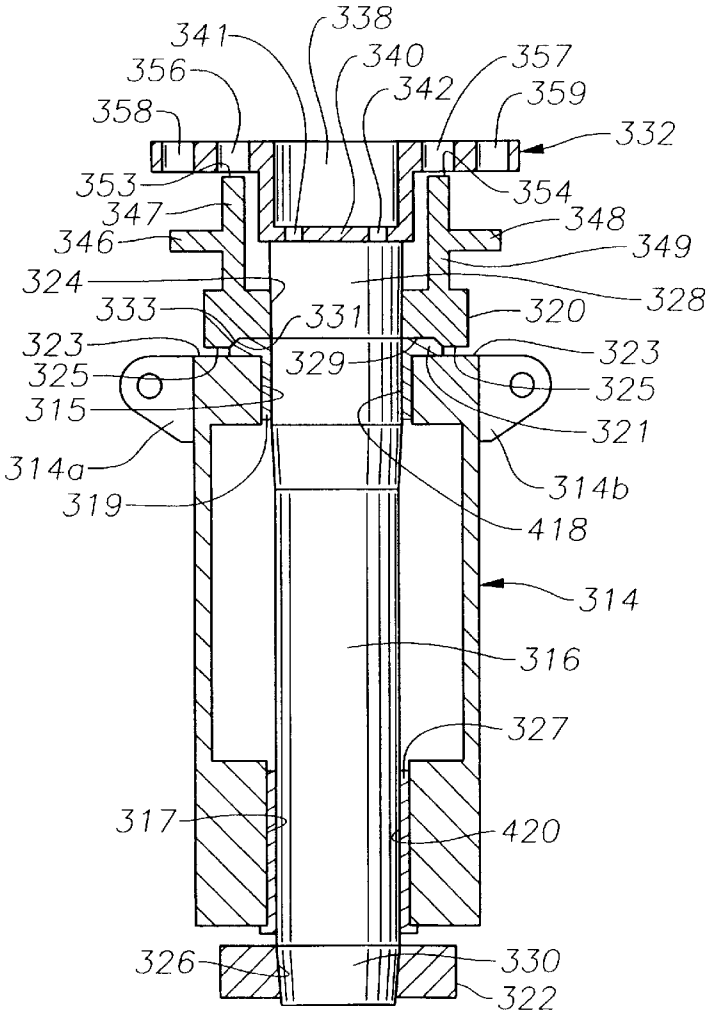
FIG. 33 is a cross-sectional view taken along line 33—33 of FIG. 30.

Referring to FIGS. 32 and 33, the first fairlead foundation support 320 includes a first aperture 324, and the second fairlead foundation support 322 includes a second aperture 326. The pivot pin 316 includes a first end 328 and a second end 330. A pivot pin retainer 332 is connected to the first end 328 of the pivot pin 316. The fairlead body 314 may include a first attachment arm 314*a*, a second attachment arm 314*b*, a first bore 315 and a second bore 317. The fairlead body 314 is secured to the support column 312 by positioning the first end 328 of the pivot pin 316 within the first aperture 324 of the first foundation support 320 and within the first bore 315 of the fairlead body 314, and by positioning the second end 330 of the pivot pin 316 within the second bore 317 of the fairlead body 314 and within the second aperture 326 of the second foundation support 322. A first bushing 319 having a tapered flange 321 may be positioned about the first end 328 of the pivot pin 316 and within the first bore 315 of the fairlead body 314, such that the tapered flange 321 is positioned between a first surface 323 of the fairlead body 314 and a second surface 325 of the first foundation support 320. The second surface 325 of the first foundation support 320 may be provided with a recessed surface 329 that defines a first inclined surface 331 for mating with second inclined surface 333 on the tapered flange 321. The operation of the first bushing 319 and of its tapered flange 321 will be discussed below. A second bushing 327 may be positioned about the second end 330 of the pivot pin 316 and within the second bore 317 of the fairlead body 314.

While at first glance FIGS. 32 and 33 appear to be identical, upon close inspection it can be seen that there are differences. These differences, which are found at the upper portions of FIGS. 32 and 33, can best be visualized by viewing FIGS. 32 and 33 in conjunction with FIG. 30, and specifically with section lines 32—32 and 33—33.

The upper portion of FIG. 32 illustrates that the pivot pin retainer 332 may include a first clamp bolt aperture 334 and a second clamp bolt aperture 335. Preferably, the pivot pin retainer 332 includes a third clamp bolt aperture (not shown) and fourth clamp bolt aperture (not shown). The pivot pin retainer 332 may also include a concentric cup portion 338 having a central member 340. The central member 340 may include a first pivot pin aperture 341 and a second pivot pin aperture 342. Preferably, the central member 340 includes a third pivot pin aperture (not shown) and a fourth pivot pin aperture (not shown). The pivot pin retainer 332 may be secured to the pivot pin 316 by passing connecting means, such as a pivot pin bolt 343, shown in FIG. 30, through the first pivot pin aperture 341 and the second pivot pin aperture 342, respectively, as well as through the preferred third and fourth pivot pin apertures, and fastening the pivot pin bolts 343 to the pivot pin 316, as by threads (not shown). It should be pointed out that the pivot pin 316 and the pivot pin retainer 332 may be made as an integral component, thereby removing the need for the first and second pivot pin apertures 342 and 344, as well as the third and fourth pivot pin apertures. Also illustrated in the upper portion of FIG. 32 is the first fairlead foundation support 320, which may include a first upstanding member 347 having a first pivot pin landing surface 353, and a second upstanding member 349 having a second pivot pin landing surface 354. The first upstanding member 347 of the first fairlead foundation support 320 should also include a first flange 346 and the second upstanding member 349 of the first fairlead foundation support 320 should also include a second flange 348. The first flange 346 includes a fifth clamp bolt aperture 350 and the second flange 348 includes a sixth clamp bolt aperture 351. Preferably, the first flange 346 includes a seventh clamp bolt aperture (not shown) and the second flange 348 includes an eighth clamp bolt aperture (not shown). When the pivot pin 316 is in its installed position, as shown in FIGS. 32 and 33, the first clamp bolt aperture 334 on the pivot pin retainer 332 is aligned with the fifth clamp bolt aperture 350 on the first fairlead foundation support 320; and the second clamp bolt aperture 335 on the pivot pin retainer 332 is aligned with the sixth clamp bolt aperture 351 on the first fairlead foundation support 320. Likewise, the third clamp bolt aperture (not shown) on the pivot pin retainer 332 is aligned with the seventh clamp bolt aperture (not shown) on the first fairlead foundation support 320; and the fourth clamp bolt aperture (not shown) on the pivot pin retainer 332 is aligned with the eighth clamp bolt aperture (not shown) on the first fairlead foundation support 320. The pivot pin retainer 332 is securely fastened to the foundation support 320 by passing connection mechanisms, such as clamp bolts 336, shown in FIG. 30, through their respective aligned clamp bolt apertures 334, 350 and 335, 351, and through aligned third and seventh clamp bolt apertures (not shown), and aligned fourth and eighth clamp bolt apertures (not shown).

Figure 34:
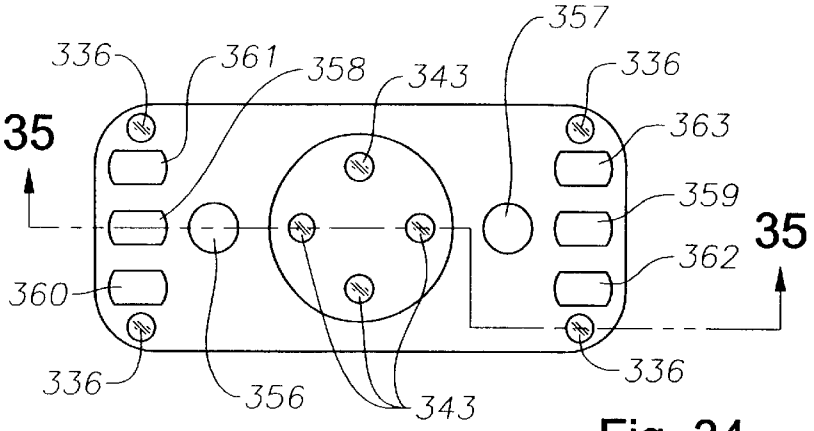
FIG. 34 is a top view of a pivot pin retainer of the specific embodiment shown in FIG. 30.
Figure 35:
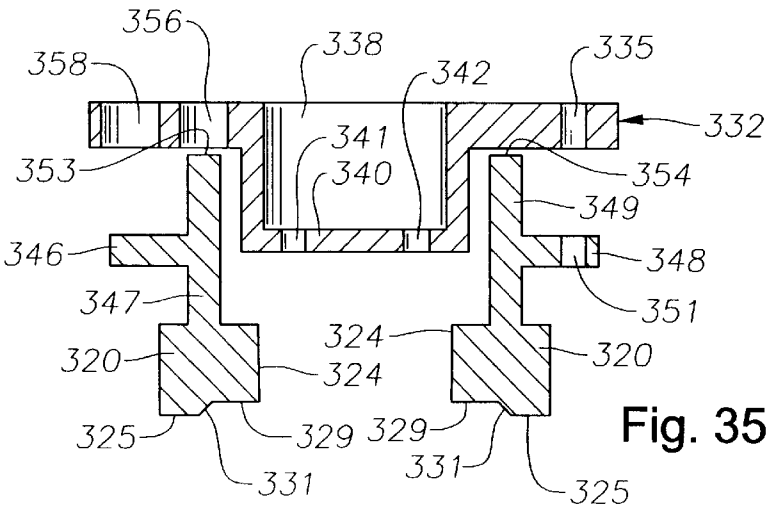
FIG. 35 is a cross-sectional view taken along line 35—35 of FIG. 34 showing the pivot pin retainer of FIG. 34 positioned directly above a first fairlead foundation support of the specific embodiment shown in FIG. 30.

Referring now to FIGS. 33 and 34, the upper portion of FIG. 33 illustrates that the pivot pin retainer 332 may include a first hydraulic ram aperture 356, a second hydraulic ram aperture 357, a first twistlock removal aperture 358, and a second twistlock removal aperture 359. As shown in FIG. 34, the pivot pin retainer 332 may also include a first twistlock reinstallation aperture 360, a second twistlock reinstallation aperture 361, a third twistlock reinstallation aperture 362, and a fourth twistlock reinstallation aperture 363. FIG. 33 further illustrates that when the pivot pin 316 is in its installed position, as shown in FIGS. 32 and 33, the first hydraulic ram aperture 356 is aligned with the first upstanding member 347 and the second hydraulic ram aperture 357 is aligned with the second upstanding member 349. FIGS. 34 and 35 further illustrate the design and structure of the pivot pin retainer 332 and the first fairlead foundation support 320, and their relationship to one another. FIG. 35 shows the pivot pin retainer 332 without the pivot pin 316 attached thereto.

The above description of the fairlead 310 of the present invention, as shown in FIGS. 30 to 35, illustrates the fairlead 310 when attached underwater to the support column 312, such that it is ready to use and operational. As discussed above, the fairlead 310 of the present invention is designed so that the fairlead body 314 can be remotely removed and reinstalled in the event mechanical difficulty with the fairlead body 314 arises and repair is required. Operational status of the fairlead 310 may be ascertained by visual inspection either by divers or by the use of a remotely operated vehicle (ROV) of the type well known to those of skill in the art, such as those having remotely operated mechanical arms and video cameras. Upon the detection of mechanical problems that require repair, the present invention provides a method of remotely removing the fairlead body 314 and retrieving it to the water surface for repair, and then reinstalling it, as will now be explained.

The first step is to attach a line extending from a crane (not shown) on the vessel's platform (not shown) to each of the attachment arms 314*a* and 314*b* on the fairlead body 314. The second step is to remove the clamp bolts 336 so as to disengage the pivot pin retainer 332 from the first foundation support 320. This can be done by the use of an ROV or by divers. The third step is to remove the pivot pin 316 so as to disengage the fairlead body 314 from the foundation supports 320 and 322. This can be done by use of the strongback 72, as shown in FIGS. 7 through 12. The strongback 72 used to remove the fairlead body 314 is described above in the first embodiment, along with its method of use, with reference to FIGS. 7 through 12. This third embodiment relates to a modified strongback 372 used during the reinstallation of the fairlead body 314 after it has been repaired.

Figure 37:
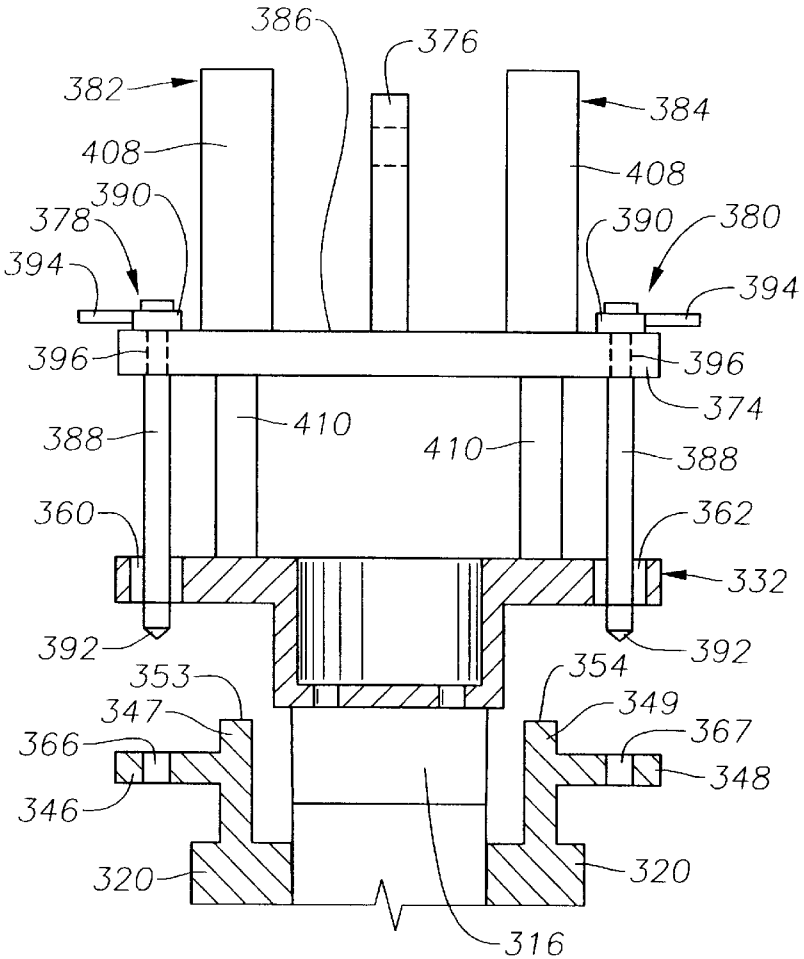
FIG. 37 is a cross-sectional view taken along line 37—37 of FIG. 30 showing the pivot pin engaged with the strongback of FIG. 36 being lowered into position for reinstallation into the foundation support members.
Figure 36:
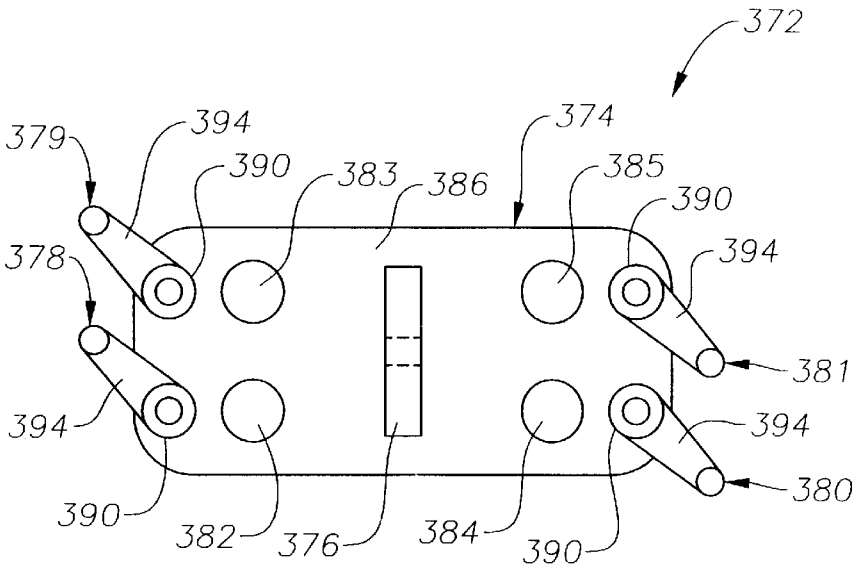
FIG. 36 is a top view of a specific embodiment of the strongback used for reinstallation of the fairlead shown in FIG. 30 to a support column (not shown) of an offshore drilling and production vessel (not shown).

Referring to FIGS. 36 and 37, the strongback 372 of this embodiment may include a main plate 374, a connector arm 376, a first twistlock 378, a second twistlock 379, a third twistlock 380, a fourth twistlock 381, a first hydraulic ram 382, a second hydraulic ram 383, a third hydraulic ram 384, and a fourth hydraulic ram 385. The connector arm 376 is secured to a first surface 386 of the main plate 374 and is substantially perpendicular thereto. As shown in FIG. 37, the first twistlock 378, second twistlock 379, third twistlock 380, and fourth twistlock 381 may each include a main shaft 388 having a head 390 and a flange 392 disposed opposite the head 390. A lever arm 394 is preferably attached to the head 390. The head 390 is adjacent the first surface 386 of the main plate 374. The shaft 388 of each the first, second, third and fourth twistlocks 378, 379, 380, 381 is rotatably located within a twistlock bore 396 in the main plate 374. The flange 392 of each of the first, second, third and fourth twistlocks 378, 379, 380, 381 is designed such that when the first, second, third and fourth twistlocks 378, 379, 380, 381 are rotated approximately 90 degrees, the flange 392 of each of the first, second, third and fourth twistlocks 378, 379, 380, 381 will be allowed to pass through the first twistlock reinstallation aperture 360, the second twistlock reinstallation aperture 361, the third twistlock reinstallation aperture 362, and the fourth twistlock reinstallation aperture 363, respectively of the pivot pin retainer 332. After the first, second, third and fourth twistlocks 378, 379, 380, 381 pass through the first, second, third and fourth twistlock reinstallation apertures 360, 361, 362, 363 of the pivot pin retainer 332, the first, second, third and fourth twistlocks 378, 379, 380, 381 may be rotated approximately 90 degrees such that the flange 392 of the first, second, third and fourth twistlocks 378, 379, 380, 381 is oriented such that the flange 392 of the first, second, third and fourth twistlocks 378, 379, 380, 381 is incapable of passing back through the first, second, third and fourth twistlock reinstallation apertures 360, 361, 362, 363 of the pivot pin retainer 332. Flanges 392 of first, second, third and fourth twistlocks 378, 379, 380, 381, however, should now be oriented such that the flanges 392 of the first, second, third and fourth twistlocks 378, 379, 380, 381 can pass through the first foundation support twistlock reinstallation aperture 366, second foundation support twistlock reinstallation aperture 367, third foundation support twistlock reinstallation aperture (not shown), and fourth foundation support twistlock reinstallation aperture (not shown), respectively, of the first fairlead foundation support 320.

Figure 39:
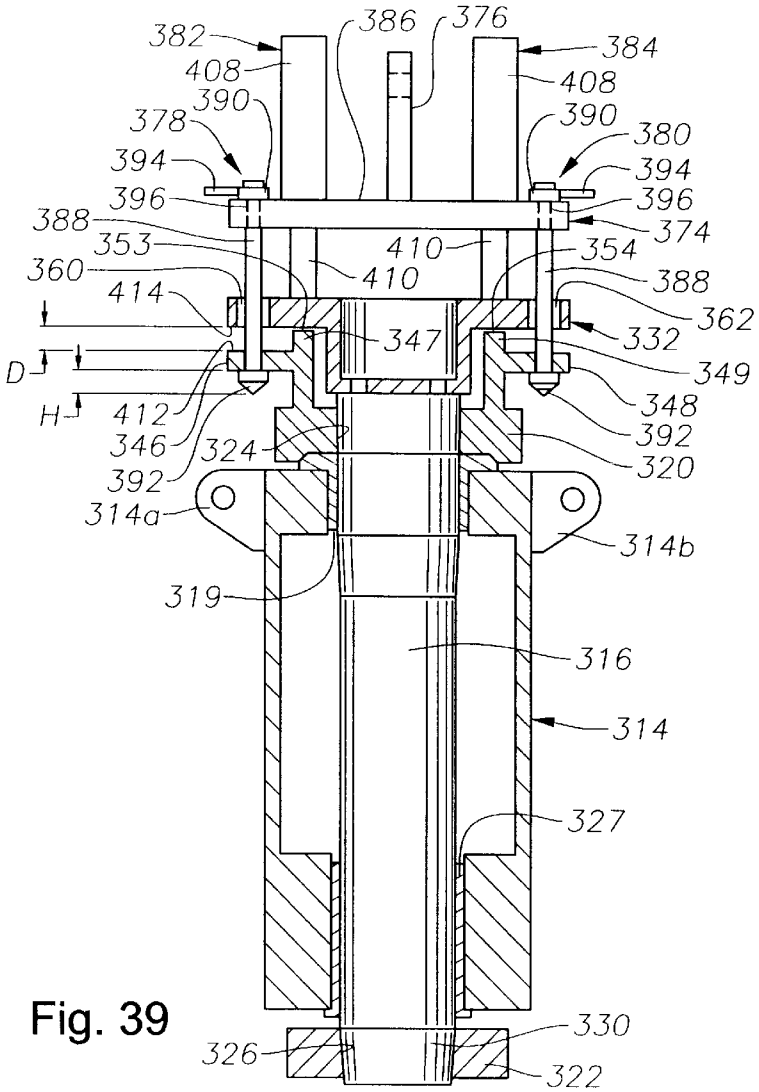
FIG. 39 is a cross-sectional view taken along line 37—37 of FIG. 30 showing the reinstalled pivot pin engaged with the strongback of FIG. 36.
Figure 38:
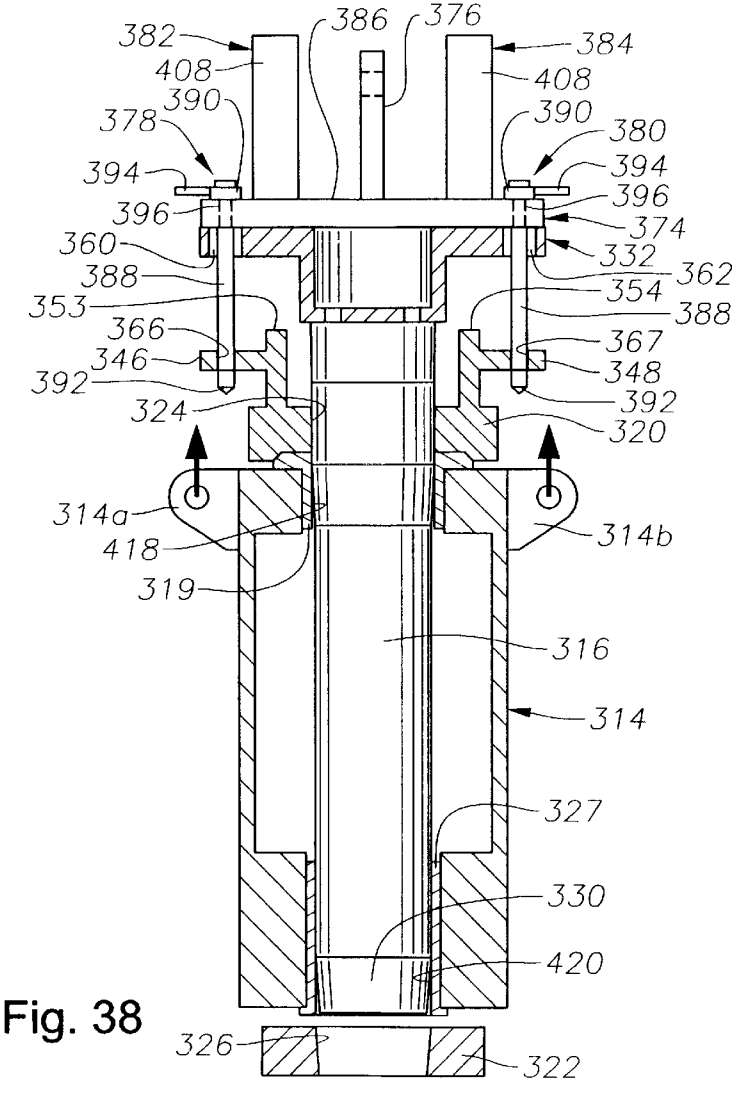
FIG. 38 is a cross-sectional view taken along line 37—37 of FIG. 30 showing the pivot pin engaged with the strongback of FIG. 36 being positioned into the pivot pin bore during reinstallation.

Referring now to FIGS. 37–39, the first hydraulic ram 382 includes a main housing 408 and a telescoping cylinder 410. The main housing 408 is secured to the main plate 374 and is substantially perpendicular to the first surface 386 thereof. The telescoping cylinder 410 extends from the main housing 408 through the main plate 374. Similarly, the second hydraulic ram 383, third hydraulic ram 384, and fourth hydraulic ram 385, include a main housing 408 and a telescoping cylinder 410 as described above in connection with the first hydraulic ram 382. Each of the telescoping cylinders 410 may extend from a fully-deployed position (see FIGS. 37 and 39) to a fully-retracted position, as shown in FIG. 38. The first, second, third and fourth hydraulic rams 382, 383, 384, 385 may be actuated by hydraulic lines (not shown) connecting each of the first, second, third and fourth hydraulic rams 382, 383, 384, 385 to a source of hydraulic fluid on the platform (not shown). Alternatively, the source of hydraulic fluid may be supplied by a remote-controlled self-contained hydraulic pump system (not shown) either mounted on-board the strongback 372 or to the support column 312.

Having described the strongback 372, its method of use will now be described. As described above, the strongback 372 of this embodiment is utilized during the reinstallation process, e.g., after the fairlead body 314 has been repaired. While it is contemplated that the strongback 372 described in this embodiment may also be used to during the removal process, preferably, this embodiment of the strongback 372 is used only during the reinstallation process. The reinstallation process will now be explained with reference to FIGS. 37 to 39.

The pivot pin 316 and pivot pin retainer 332 must first be connected to the strongback 372 by locking the pivot pin retainer 332 to the strongback 372 as shown in FIG. 37 prior to beginning the reinstallation process. Preferably, the pivot pin retainer 332 is locked to the strongback 372 by passing the flanges 392 of the first, second, third and fourth twistlocks 378, 379, 380, 381 through the first, second, third and fourth twistlock reinstallation apertures 360, 361, 362, 363 of the pivot pin retainer 332. The first, second, third and fourth twistlocks 378, 379, 380, 381 are rotated approximately 90 degrees such that the flanges 392 of the first, second, third and fourth twistlocks 378, 379, 380,381 are oriented such that the flanges 392 can not pass back through the first, second, third and fourth twistlock reinstallation apertures 360, 361, 362, 363 of the pivot pin retainer 332. The telescoping cylinders 410 are then fully deployed thereby securing the pivot pin retainer 332 to the strongback 372 such that the pivot pin retainer 332 is incapable of movement along the shaft 388 of the first, second, third and fourth twistlocks 378,379,380,381. As shown in FIG. 37, the shafts 388 of the first, second, third and fourth twistlocks 378, 379, 380, 381 have a length which allows the telescoping cylinders 410 of the first, second, third and fourth hydraulic rams 382, 383, 384, 385 to be fully deployed when the strongback 372 is secured to the pivot pin retainer 332 by the flanges 392 of the first, second, third and fourth twistlocks 378, 379, 380, 381.

The crane (not shown) should be used to lower the fairlead body 314 into the water and to position the fairlead body 314 between the foundation supports 320 and 322, as shown in FIGS. 38 and 39. The strongback 372 and chain messenger line (not shown) are used to lower the pivot pin 316 into position. Before the pivot pin 316 is placed through the pivot pin bore (the pivot pin bore may be defined by the first aperture 324 in the first fairlead foundation support 320, a first bushing bore 418 in the first bushing 319, a second bushing bore 420 in the second bushing 327, and the second aperture 326 in the second foundation support 322), the fairlead body 314 may be lifted upwardly, as shown in FIG. 38, to align, or center, the first aperture 324 in the first fairlead foundation support 320 with the first bushing bore 418 in the first bushing 319 so that the pivot pin 316 will fit into the pivot pin bore. This alignment takes place because the recessed surface 329 of the first fairlead foundation support 320 is provided with its first inclined surface 331, as identified previously in connection with the above discussion of FIGS. 32 and 33, which is designed to mate with the second inclined surface 333 on the tapered flange 321 of the first bushing 319. Accordingly, as the fairlead body 314 is lifted upwardly, the interaction of the first and second inclined surfaces 331 and 333 guide the first aperture 324 in the first fairlead foundation support 320 into alignment with the first bushing bore 418 in the first bushing 319.

The pivot pin 316 is then lowered as far as possible into the pivot pin bore. In most situations, the pivot pin 326 will not be fully installed into the pivot pin bore by lowering the pivot pin 316. In these situations, at the point the pivot pin 316 is no longer capable of being lowered into the pivot pin bore, the telescoping cylinders 410 of the first, second, third and fourth hydraulic rams 382, 383, 384,385 may be retracted and the strongback 372 allowed to continue to move downward until the main plate 374 of the strongback 372 contacts the pin pivot retainer 332. While the strongback 372 is lowered to contact the pivot pin retainer 332, the flanges 392 of the first, second, third and fourth twistlocks 378, 379, 380, 381 should pass through the first foundation support twistlock reinstallation aperture 366, second foundation support twistlock reinstallation aperture 367, third foundation support twistlock reinstallation aperture (not shown) and the fourth foundation support twistlock reinstallation aperture (not shown) of the first fairlead foundation support 320. The flanges 392 of the first, second, third and fourth twistlocks 378, 379, 380, 381 may then be rotated approximately 90 degrees thereby preventing the removal of the flanges 392 of the first, second, third and fourth twistlocks 378, 379, 380, 381 from the first foundation support twistlock reinstallation aperture 366, second foundation support twistlock reinstallation aperture 367, third foundation support twistlock reinstallation aperture (not shown), and the fourth foundation support twistlock reinstallation aperture (not shown) of the first fairlead foundation support 320 (FIG. 39). The telescoping cylinders 410 of the first, second, third and fourth hydraulic rams 382,383, 384,385 may then be fully deployed thereby fully installing the pivot pin 316 through the pivot pin bore and foundation supports 320 and 322 such that the pivot pin retainer 332 is in contact with the first pivot pin landing surface 353 of the first upstanding member 347 and the second pivot pin landing surface 354 of the second upstanding member 349 of the first fairlead foundation support 320 as shown in FIG. 39.

After the pivot pin 316 is properly positioned, as shown in FIG. 39, the strongback 372 is disconnected from the pivot pin retainer 332 by rotating the first, second, third and fourth twistlocks 378, 379, 380, 381 approximately 90 degrees such that the flanges 392 of the first, second, third and fourth twistlocks 378, 379, 380, 381 are oriented such that the flanges 392 of the first, second, third and fourth twistlocks 378, 379, 380, 381 will pass through the first foundation support twistlock reinstallation aperture 366, second foundation support twistlock reinstallation aperture 367, third foundation support twistlock reinstallation aperture (not shown), and the fourth foundation support twistlock reinstallation aperture (not shown), respectively, of the first fairlead foundation support 320. After the flanges 392 of the first, second, third and fourth twistlocks 378, 379, 380, 381 pass through the first foundation support twistlock reinstallation aperture 366, second foundation support twistlock reinstallation aperture 367, third foundation support twistlock reinstallation aperture (not shown), and the fourth foundation support twistlock reinstallation aperture (not shown) of the first fairlead foundation support 320, the flanges 392 of the first, second, third and fourth twistlocks 378, 379, 380, 381 may then be rotated approximately 90 degrees to orient the flanges 392 of the first, second, third and fourth twistlocks 378, 379, 380, 381 such that they will pass through the first, second, third and fourth twistlock reinstallation apertures 360, 361, 362, 363 of the pivot pin retainer 332. In this regard, with reference to FIG. 39, when the pivot pin 316 is in its installed position, the distance D between an upper surface 412 of the first flange 346 and a lower surface 414 of the pivot pin retainer 332 is greater than the height H of the twistlock flange 392. This clearance is necessary to permit rotation of the twistlock flange 392 after removal from the first flange 346 and before being passed through the first twistlock reinstallation aperture 360 in the pivot pin retainer 332. The same is true with regard to the clearance between the pivot pin retainer 332 and the second flange 348. After the flanges 392 of the twistlocks 378, 379,380, 381 pass through the first, second, third and fourth twistlock reinstallation apertures 360, 361, 362, 363 of the pivot pin retainer 332, the strongback 372 is freed from its connection to the pivot pin retainer 332, and may then be raised to the platform (not shown).

The pivot pin retainer 332 may then be locked to the first fairlead foundation support 320 by use of the clamp bolts 336, as shown in FIG. 34 and as explained above in connection with FIG. 32. More particularly, with reference to FIGS. 32 and 39, a clamp bolt 336 is inserted through the first clamp bolt aperture 334 in the pivot pin retainer 332 and through the fifth clamp bolt aperture 350 in the first flange 346 on the first fairlead foundation support 320. Similarly, other clamp bolts 336 are inserted through the second clamp bolt aperture 335 in the pivot pin retainer 332 and through the sixth clamp bolt aperture 351 in the second flange 348 on the first fairlead foundation support 320; through the third clamp bolt aperture (not shown) in the pivot pin retainer 332 and through the seventh clamp bolt aperture (not shown) in the second flange 348 on the first fairlead foundation support 320; and through the fourth clamp bolt aperture (not shown) in the pivot pin retainer 332 and through the eighth clamp bolt aperture (not shown) in the second flange 348 on the first fairlead foundation support 320. Finally, the crane (not shown) that was used to lower the fairlead body 314 into position, and to hold it there, may now be disconnected from the attachment arms 314*a* and 314*b* on the fairlead body 314.

It is to be understood that the invention is not limited to the exact details of construction, operation, exact materials or embodiments shown and described, as obvious modifications and equivalents will be apparent to one skilled in the art. For example, for purposes of explanation and illustration only, the fairlead apparatus and method of the present invention has primarily been explained and illustrated in connection with SPAR-type vessels. However, it is not intended that the scope of protection be limited to use with only SPAR-type vessels. Instead, as will be readily apparent to those of skill in the art, there may be other offshore drilling and production mechanisms with which the fairlead apparatus and method of the present invention may be used, all of which are intended to be covered within the spirit and scope of the present invention. Further, while the third embodiment has been described for use during reinstallation of the pivot pin, the strongback of the third embodiment may also be used to remove the pivot pin. Also, the strongback of the first embodiment may be combined with the strongback of the third embodiment, thereby forming a strongback that may be used during removal and reinstallation of the pivot pin. Accordingly, the invention is therefore to be limited only by the scope of the appended claims.

What is claimed is:

1. An apparatus for remotely removing and installing a removable underwater fairlead, the fairlead including a fairlead body hingedly connected between a first and a second fairlead foundation support by a pivot pin, the first fairlead foundation support having at least one upstanding member having a ram landing surface, the pivot pin being connected to a pivot pin retainer having at least one twistlock aperture and at least one ram aperture, the apparatus comprising:

a main plate having a first surface and a second surface;

a connector arm secured to the first surface of the main plate;

at least one twistlock having a main shaft, a head, a lever arm attached to the head, and a flange, the head and flange being disposed at opposite ends of the main shaft, the main shaft being rotatably disposed within a twistlock bore in the main plate; and at least one ram connected to the main plate and having a telescoping cylinder movable between a retracted position and a deployed position.

2. The apparatus of claim 1, wherein the head of the at least one twistlock is disposed adjacent the first surface of the main plate.

3. The apparatus of claim 1, wherein the twistlock shaft is adapted for being rotatably disposed within the at least one twistlock aperture in the pivot pin retainer, and the twistlock flange is releasably engageable with the pivot pin retainer to releasably connect the main plate to the pivot pin retainer.

4. The apparatus of claim 1, wherein the telescoping cylinder is adapted for being inserted through the at least one ram aperture in the pivot pin retainer to engage the ram landing surface of the at least one upstanding member on the first fairlead foundation support.

5. The apparatus of claim 1, wherein the at least one ram is a hydraulic ram having a housing connected and substantially perpendicular to the first surface of the main plate, the telescoping cylinder extending from the housing through the main plate.

6. An apparatus for remotely installing under water a removable underwater fairlead between a first and a second fairlead foundation support, the first fairlead foundation support having at least one upstanding member having a ram landing surface and at least one flange having a foundation twistlock aperture, the at least one flange being spaced from the ram landing surface, the pivot pin being connected to a pivot pin retainer having at least one twistlock installation aperture, the apparatus comprising:

a main plate having a first surface and a second surface;

a connector arm secured to the first surface of the main plate;

at least one twistlock having a main shaft, a head, a lever arm attached to the head, and a flange, the head and flange being disposed at opposite ends of the main shaft, the main shaft being rotatably disposed within a twistlock bore in the main plate; end at least one ram connected to the main plate and having a telescoping cylinder movable between a retracted position and a deployed position.

7. The apparatus of claim 6, wherein the head of the at least one twistlock is disposed adjacent the first surface of the main plate.

8. The apparatus of claim 6, wherein the twistlock shaft is adapted for being rotatably disposed within the at least one twistlock installation aperture in the pivot pin retainer, the twistlock flange is releasably engageable with the pivot pin retainer, and the telescoping cylinder is adapted to engage the pivot pin retainer to releasably secure the pivot pin retainer to the installation apparatus between the telescoping cylinder and the twistlock flange.

9. The apparatus of claim 6, wherein the twistlock shaft is adapted for being rotatably disposed within the at least one foundation twistlock installation aperture in the at least one flange on the first foundation support, the twistlock flange is releasably engageable with the at least one flange on the first foundation support to secure the installation apparatus to the first foundation support, and the telescoping cylinder is adapted to engage the pivot pin retainer to force the pivot pin into engagement with the first and second foundation supports and the fairlead body.

10. The apparatus of claim 6, wherein the at least one ram is a hydraulic ram having a housing connected and substantially perpendicular to the first surface of the main plate, the telescoping cylinder extending from the housing through the main plate.

11. An apparatus for remotely removing and installing a removable underwater fairlead, the fairlead including a fairlead body hingedly connected between a first and a second fairlead foundation support by a pivot pin, the first fairlead foundation support being connected to an offshore platform and having a guiding sleeve, the apparatus comprising:

a housing;

a jack screw having a first end and a second end, and being disposed for longitudinal movement within the housing, and releasably engageable with the pivot pin; and a motor connected to the jack screw.

12. The apparatus of claim 11, wherein the motor is a hydraulic motor, and further including a source of pressurized fluid in communication with the hydraulic motor.

13. The apparatus of claim 11, wherein the second end of the jack screw is adapted for releasable engagement with an at least one mounting arm extending from a first end of the pivot pin.

14. The apparatus of claim 13, wherein the at least one mounting arm includes a first locking bore, and the second end of the jack screw includes a connecting bore, the locking bore and the connecting bore being adapted to receive a locking pin to fasten the jack screw to the pivot pin.

15. The apparatus of claim 11, further including a gear box connected between the jack screw and the motor.

* * * * *